US011958656B2

(12) United States Patent
Taylor et al.

(10) Patent No.: US 11,958,656 B2
(45) **Date of Patent: *Apr. 16, 2024**

(54) STORAGE BOX

(71) Applicant: IDEASTREAM CONSUMER PRODUCTS, LLC, Cleveland, OH (US)

(72) Inventors: Curtis Taylor, Chagrin Falls, OH (US); Daniel Perella, Hudson, OH (US); Matthew Hanson, Chagrin Falls, OH (US)

(73) Assignee: IdeaStream Consumer Products, LLC, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/102,968

(22) Filed: Jan. 30, 2023

(65) Prior Publication Data

US 2023/0174272 A1 Jun. 8, 2023

Related U.S. Application Data

(63) Continuation of application No. 16/877,766, filed on May 19, 2020, now Pat. No. 11,565,848, which is a continuation-in-part of application No. 16/546,414, filed on Aug. 21, 2019, now abandoned.

(60) Provisional application No. 62/720,282, filed on Aug. 21, 2018.

(51) Int. Cl.

| | |
|---|---|
| ***B65D 21/02*** | (2006.01) |
| ***B65D 25/04*** | (2006.01) |
| ***B65D 25/20*** | (2006.01) |
| ***B65D 25/28*** | (2006.01) |
| ***B65D 43/16*** | (2006.01) |
| ***B65D 43/22*** | (2006.01) |

(52) U.S. Cl.

CPC ..... *B65D 21/0223* (2013.01); *B65D 21/0233* (2013.01); *B65D 25/04* (2013.01); *B65D 25/20* (2013.01); *B65D 25/2897* (2013.01); *B65D 43/162* (2013.01); *B65D 43/22* (2013.01)

(58) Field of Classification Search

CPC .... B65D 43/169; B65D 21/064; B65D 25/04; B65D 43/22

USPC ..... 220/500, 527, 553, 554

See application file for complete search history.

(56) References Cited

U.S. PATENT DOCUMENTS

| | | | | |
|---|---|---|---|---|
| 5,322,178 | A | 6/1994 | Foos | |
| 5,601,206 | A * | 2/1997 | Haas | B60R 11/06 220/264 |
| 5,624,051 | A * | 4/1997 | Ahern, Jr. | B65D 21/0233 220/793 |
| 6,308,858 | B1 | 10/2001 | Koefelda | |
| 9,474,420 | B2 * | 10/2016 | Oakes | A47J 47/14 |
| 2010/0308066 | A1 | 12/2010 | Perry et al. | |
| 2012/0048874 | A1 | 3/2012 | Oakes et al. | |

(Continued)

*Primary Examiner* — Jeffrey R Allen

(74) *Attorney, Agent, or Firm* — Dickinson Wright PLLC

(57) ABSTRACT

The present disclosure relates to storage boxes commonly used to organize and store items such as school-related supplies that may be carried by a student. The storage boxes generally include a lid and a base. The base optionally includes a divider which provides for two or more storage portions within an interior of the base, while also acting as a functional grip on the outside of the box. A latch mechanism is provided which securely latches the lid and base together in a closed configuration.

19 Claims, 13 Drawing Sheets

(56) References Cited

U.S. PATENT DOCUMENTS

2014/0097183 A1* 4/2014 McGrath ..... B65D 43/169
220/212

* cited by examiner

STORAGE BOX

CROSS REFERENCE TO RELATED APPLICATIONS

This application is a continuation of U.S. application Ser. No. 16/877,766 filed May 19, 2020, which in turn is a continuation-in-part of U.S. application Ser. No. 16/546,414 filed Aug. 21, 2019, which in turn claims priority to U.S. Provisional Application No. 62/720,282, filed Aug. 21, 2018, the disclosures of which are herein incorporated by reference in its entirety.

SUMMARY

The present disclosure relates to storage boxes commonly used to organize and store items, such as school-related supplies that may be carried by a student. The storage boxes generally include a lid and a base. The base includes a divider which provides for two or more storage portions within an interior of the base, while also acting as a functional grip on the outside of the box. A latch mechanism is provided which securely latches the lid and base together in a closed configuration.

BACKGROUND

There are a variety of storage devices used by students in the marketplace today for storing and organizing items such as school-related supplies. A two-piece lid and base box are common components of a device used for such storage and organization. Existing storage boxes are often provided with only one common interior storage portion, making organization difficult. Other existing storage boxes have attempted to provide dividers within the interior storage portion; however, these existing boxes have sacrificed capacity to do so. Moreover, known storage boxes used in the marketplace today can be difficult to grip, especially by users with smaller hands, such as young school children. Also, known storage boxes used in the marketplace today commonly have the lid pop open when the storage box is dropped resulting in the contents of the storage container falling or spilling out of the storage box.

The configuration of known storage boxes generally requires the storage boxes to be stacked on top of one another on retail shelves while the storage boxes have the lids closed since the storage boxes are not configured to be stackable with the lids open. As such, a limited number of storage boxes can be stacked on a retail shelf. Some known storage boxes can be stacked in limited qualities (generally less than 10) before the stacked storage boxes create an unstable column of stack storage boxes that is prone to tip over while on the retail shelf.

In view of the prior art, there remains a need for a novel storage box that provides 1) sufficient organization without sacrificing capacity, 2) provides sufficient grip to the outside of the box, 3) resists opening when dropped, and/or 4) can be vertically stacked together on retail shelves.

BRIEF DESCRIPTION OF THE INVENTION

The present disclosure is directed to storage boxes commonly used to organize and store school-related supplies that may be carried by a student. Such storage boxes may also commonly be referred to as pencil boxes; however, any desired item that can fit within the storage box could also be stored/organized (e.g., pens, erasers, scissors, crayons, markers, tape, correction fluid, chalk, etc.).

In one non-limiting aspect of the present disclosure, the exemplary storage box includes a lid component and a base component. A connection means attaches the lid component to the base component on at least one side thereof. In one non-limiting embodiment, the connection means can include, but is not limited to, a flexible connector (e.g., plastic flexible connector, fabric flexible connector, etc.), hinge, etc. In accordance with another non-limiting aspect of the present disclosure, the lid component and the base component are configurable between an open configuration and a closed configuration.

In accordance with another non-limiting aspect of the disclosure, the base component includes an optional divider configured to separate the interior of the storage box into two or more interior storage portions. In some non-limiting configurations, when the lid component and base component are in the closed configuration, the divider prevents items stored in the two or more interior storage portions from moving into another one of the two or more interior storage portions. In this regard, the exemplary storage box advantageously maintains the organization of items stored in the storage box without sacrificing capacity.

In accordance with another non-limiting aspect of the disclosure, the divider on base of the presently described storage boxes is optionally adapted to provide a grip arrangement on the outside of the box. The grip arrangement is configured to facilitate in gripping the storage box.

In accordance with another non-limiting aspect of the disclosure, there is provided a storage box which includes a base component with an open interior and a lid component attached to the base component. The storage box has a closed configuration where the lid component is closed against the base component and an open configuration where the lid component is moveable with respect to the base component. An optional divider is included which separates the interior of the base component into two or more storage areas. The storage box optionally includes a recessed grip on an exterior surface of the base component to facilitate in the gripping of the storage box. The storage box optionally includes a grooved or non-smooth top surface of the lid component to facilitate in the gripping of the storage box.

In accordance with another non-limiting aspect of the disclosure, the optional divider of the storage box is optionally integrally formed with the base component. In addition, the grip can also be integrally formed with the base component.

In accordance with another non-limiting aspect of the disclosure, the optional divider is optionally formed from one or more ridges on a bottom wall of the base component and an underside of the one or more ridges defines the recessed grip on the exterior surface of the base component. In accordance with additional non-limiting aspects, the recessed grip is optionally formed from one or more channels on a bottom wall of the base component.

In accordance with another non-limiting aspect of the disclosure, the storage box optionally includes ruler markings disposed on the exterior surface of the base component and adjacent a lower portion thereof. The ruler markings can optionally be made of a plurality of indentations and/or ribs formed on the exterior surface of the base.

In accordance with another non-limiting aspect of the disclosure, the storage box includes a latch mechanism configured to secure the lid component and base component in the closed configuration. The latch mechanism optionally includes a latch member disposed on the lid component that is configured to engage an optional rim disposed on the base component.

In accordance with another non-limiting aspect of the disclosure, the storage box optionally includes a hinge/flexible member which connects at least one wall of the lid component to at least one wall of the base component.

In accordance with another non-limiting aspect of the disclosure, the storage box optionally has a stop wall disposed on the base component and one or more retaining walls disposed on the lid component. The one or more retaining walls are configured to engage the stop wall and inhibit or prevent the lid component from over-extending past the base component in the closed configuration.

In accordance with another non-limiting aspect of the disclosure, the storage box optionally includes one or more stacking features configured to enable a stacked configuration of a plurality of storage boxes in the open configuration. In such non-limiting embodiments with one or more stacking features, the one or more stacking features optionally include one or more apertures and one or more retaining walls located on the lid component. The one or more apertures on a lid component of an upper storage box in the plurality of open configuration storage boxes are configured to receive the one or more retaining walls on a lid component of a lower storage box in the plurality of open configuration storage boxes. In other non-limiting embodiments with one or more stacking features, the one or more stacking features optionally include a ridge extending around at least a portion of a perimeter of the lid component. The ridge on a lid component of an upper storage box in the plurality of open configuration storage boxes is configured to receive the ridge on a lid component of a lower storage box in the plurality of open configuration storage boxes. In additional non-limiting embodiments with one or more stacking features, the one or more stacking features optionally include an indent and a barb disposed on the lid component. The indent on a lid component of an upper storage box in the plurality of open configuration storage boxes is configured to receive the barb on a lid component of a lower storage box in the plurality of open configuration storage boxes.

In accordance with another non-limiting aspect of the disclosure, the storage box optionally includes one or more stacking features configured to enable a stacked configuration of a plurality of storage boxes in the open configuration such that when two of more storage boxes are stacked together, the bottom of the base component of the two of more stacked storage boxes and the top surface of the lid component are parallel to one another. Such an arrangement enables large numbers (e.g., >10, >20, >30, >40) of storage containers to be stacked vertically such that both the plane of the bottom of the base component of each of the stacked storage boxes are parallel to one another, and the plane of the top surface of the lid component of each of the stacked storage boxes are parallel to one another. As such, a plurality of storage containers can be stacked vertically on a storage shelf while the lid component of the stacked storage containers is in an open configuration. In such an arrangement the central vertical axis of the stacked storage containers is generally normal (85-95°, 90°) to the surface of a shelf.

Generally, a first storage box that is stacked on a second storage box such that the base component of the first storage box is partially nested in the cavity of the base component of the second storage box such that about 50-99% of the base component of a first storage box (and all values and ranges therebetween) is nested in the cavity of the base component of the second storage box and simultaneously about 50-99% of the top component of a first storage box (and all values and ranges therebetween) is nested in the cavity of the top component of the second storage box, and typically the base component of the first storage box is partially nested in the cavity of the base component of the second storage box such that about 60-98% of the base component of a first storage box is nested in the cavity of the base component of the second storage box and simultaneously about 60-98% of the top component of a first storage box is nested in the cavity of the top component of the second storage box, and more typically the base component of the first storage box is partially nested in the cavity of the base component of the second storage box such that about 75-98% of the base component of a first storage box is nested in the cavity of the base component of the second storage box and simultaneously about 65-98% of the top component of a first storage box is nested in the cavity of the top component of the second storage box, and even more typically the base component of the first storage box is partially nested in the cavity of the base component of the second storage box such that about 80-98% of the base component of a first storage box is nested in the cavity of the base component of the second storage box and simultaneously about 65-95% the top component of a first storage box is nested in the cavity of the top component of the second storage box.

In accordance with another non-limiting aspect of the disclosure, the storage box optionally includes one or more latch engagement arrangements used to limit or prevent the inadvertent opening of the storage box when in the closed configuration. In one non-limiting embodiment, the lid component includes one or more retaining walls positioned on the interior surface of the lid component. The one or more retaining walls can optionally be configured to limit movement of the latch mechanism relative to the base component of the storage box in the longitudinal and/or transverse directions. In one non-limiting specific arrangement, the one or more retaining walls can optionally be configured such that at least a portion of the one or more retaining walls extends into a portion of the cavity of the base component when the lip component is in the closed configuration. In the non-limiting configuration, a portion of an upper edge region of the base component is entrapped between a portion of the one or more retaining walls and a portion of the latch mechanism when the lip component is in the closed configuration. Such entrapment of the upper edge region of the base component limits the movement of the lip component relative to the base component such as when, but not limited to, a situation wherein the storage box inadvertently falls on the ground, thereby inhibiting or preventing the latch mechanism on the lid component from disengaging from the base component and allowing the lid component to move from the closed configuration to the open configuration. In another non-limiting embodiment, the latch mechanism on the lid component includes one or more barbs that are configured to engage a portion of the base component when the lid component is in the closed configuration. In one non-limiting specific arrangement, a portion of the one or more barbs are configured to engage a bottom of a rim located on the base component. The thickness of the one or more barbs is such that when in, but not limited to, a situation wherein the storage box inadvertently falls on the ground, one or more barbs resist disengaging from the bottom of the rim located on the base component thereby inhibiting or preventing the latch mechanism on the lid component from disengaging from the base component. In another non-limiting embodiment, the base component includes one or more stops that limit lateral movement of the latch mechanism on the lid component relative to the base component when the lid component is in the closed configuration. In one non-limiting specific arrangement, the base component includes two stops located on an exterior surface of the base component and wherein the two stops are spaced from one another to enable a portion of the latch mechanism on the lid component to fit between the two stops when the latch mechanism engages the base portion to retain the lid component in the closed configuration. The two stops are configured to limit lateral movement of the latch mechanism relative to the base component when the lid component is in the closed configuration thereby inhibiting or preventing the latch mechanism from disengaging from the base component such as when, but not limited to, a situation wherein the storage box inadvertently falls on the ground.

In accordance with another non-limiting aspect of the disclosure, there is provided a method of making a storage box which includes 1) providing a base component with an open interior and a lid component attached to the base component, wherein the lid component is closed against the base component in a closed configuration and the lid component is moveable with respect to the base component in an open configuration; 2) optionally dividing the interior of the base component into two or more storage areas by forming one or more ridges on a bottom wall of the base component; and, 3) optionally forming one or more channels on an exterior surface of the bottom wall of the base component to provide a recessed grip.

In accordance with another non-limiting aspect of the disclosure, the method includes providing a plurality of storage boxes in a stacked configuration, wherein each storage box in the plurality is in the open configuration. The method also includes forming one or more stacking features on the lid component of each storage box in the plurality of storage boxes.

In such non-limiting embodiments with one or more stacking features, the method further includes engaging the one or more stacking features on a lid component of an upper box in the plurality of storage boxes with the one or more stacking features on a lid component of a lower storage box in the plurality of storage boxes.

In additional non-limiting embodiments with one or more stacking features, the method also includes selecting the one or more stacking features on each lid in the plurality of storage boxes that optionally include at least one of an indent and a barb, one or more apertures and one or more retaining walls, and a ridge extending around a perimeter portion of the lid component.

In accordance with a third non-limiting aspect of the disclosure, there is provided a storage box which includes a base component with an open interior and a lid component attached to the base with a hinge. In a closed configuration of the storage box, the lid component is closed against the base component. In an open configuration of the storage box, the lid component is moveable with respect to the base component. A latch mechanism configured to secure the lid component and base component in the closed configuration is also included. In addition, one or more ridges are optionally formed in the base component which divide the interior into two or more storage areas. Furthermore, an optional recessed grip on an exterior surface of the base component is defined by an underside of the one or more ridges. An optional ruler is included which is disposed on the exterior surface of the base component; the ruler is comprised of a plurality of indentations/ribs formed on the exterior surface of the base component. Finally, one or more stacking features are optionally formed on the lid component.

In such non-limiting embodiments with one or more stacking features, a plurality of storage boxes in a stacked configuration is also optionally provided. Each storage box in the plurality is in the open configuration and the one or more stacking features on each lid component in the plurality of storage boxes are optionally configured to engage with one another to maintain the stacked configuration of the plurality of storage boxes.

In one non-limiting object of the invention, there is the provision of a storage box comprising 1) a base component with an open interior; 2) a lid component attached to the base component; 3) a closed configuration wherein the lid component is closed against the base component and an open configuration where the lid component is moveable with respect to the base component; 4) an optional divider which separates the interior of the base component into two or more storage areas; and, 5) an optional recessed grip on an exterior surface of the base component.

In another non-limiting object of the invention, there is the provision of a storage box wherein the divider is integrally formed with the base component.

In another non-limiting object of the invention, there is the provision of a storage box wherein the grip is integrally formed with the base component.

In another non-limiting object of the invention, there is the provision of a storage box wherein the divider is comprised of one or more ridges formed on a bottom wall of the base component and an underside of the one or more ridges defines the recessed grip on the exterior surface of the base component.

In another non-limiting object of the invention, there is the provision of a storage box wherein the recessed grip is comprised of one or more channels formed on a bottom wall of the base component.

In another non-limiting object of the invention, there is the provision of a storage box further comprising a ruler disposed on the exterior surface of the base component and adjacent a lower portion thereof.

In another non-limiting object of the invention, there is the provision of a storage box wherein the ruler is comprised of a plurality of indentations formed on the exterior surface of the base component.

In another non-limiting object of the invention, there is the provision of a storage box further comprising a latch mechanism configured to secure the lid component and base in the closed configuration, the latch mechanism including a resiliently biased member disposed on the lid component and a flat rim disposed on the base component.

In another non-limiting object of the invention, there is the provision of a storage box further comprising a hinge which connects at least one wall of the lid component to at least one wall of the base component.

In another non-limiting object of the invention, there is the provision of a storage box further comprising a stop wall disposed on the base component and one or more retaining walls disposed on the lid component, wherein the one or more retaining walls are configured to engage the stop wall and prevent the lid component from over-extending past the base in the closed configuration.

In another non-limiting object of the invention, there is the provision of a storage box further comprising one or more stacking features configured to enable a stacked configuration of a plurality of storage boxes in the open configuration.

In another non-limiting object of the invention, there is the provision of a storage box wherein the one or more stacking features include one or more apertures and one or more retaining walls located on the lid component, wherein the one or more apertures on a lid component of an upper storage box in the plurality of open configuration storage boxes is configured to receive the one or more retaining walls on a lid component of a lower storage box in the plurality of open configuration storage boxes.

In another non-limiting object of the invention, there is the provision of a storage box wherein the one or more stacking features includes a ridge extending around at least a portion of a perimeter of the lid component, wherein the ridge on a lid component of an upper storage box in the plurality of open configuration storage boxes is configured to receive the ridge on a lid component of a lower storage box in the plurality of open configuration storage boxes.

In another non-limiting object of the invention, there is the provision of a storage box wherein the one or more stacking features includes an indent and a barb disposed on the lid component, wherein the indent on a lid component of an upper storage box in the plurality of open configuration storage boxes is configured to receive the barb on a lid component of a lower storage box in the plurality of open configuration storage boxes.

In another non-limiting object of the invention, there is the provision of a storage box that provides 1) sufficient organization without sacrificing capacity, 2) provides sufficient grip to the outside of the box, 3) resists opening when dropped, and/or 4) can be vertically stacked together on retail shelves.

In another non-limiting object of the invention, there is the provision of a storage box that can be used to organize and store school-related supplies that may be carried by a student.

In another non-limiting object of the invention, there is the provision of a storage box that includes a grip arrangement that is configured to facilitate in holding the grasping the storage box.

In another non-limiting object of the invention, there is the provision of a storage box that optionally includes a divider which separates the interior of the base component into two or more storage areas.

In another non-limiting object of the invention, there is the provision of a storage box that optionally includes a recessed grip on an exterior surface of the base component to facilitate in the gripping of the storage box.

In another non-limiting object of the invention, there is the provision of a storage box that optionally includes a grooved or non-smooth top surface of the lid component to facilitate in the gripping of the storage box.

In another non-limiting object of the invention, there is the provision of a storage box that optionally includes ruler markings that can optionally be made of a plurality of indentations and/or ribs formed on the exterior surface of the base component.

In another non-limiting object of the invention, there is the provision of a storage box that optionally includes a stop wall disposed on the base component and one or more retaining walls disposed on the lid component to inhibit or prevent the lid component from over-extending past the base component in the closed configuration.

In another non-limiting object of the invention, there is the provision of a storage box that optionally includes one or more stacking features configured to enable a stacked configuration of a plurality of storage boxes in the open configuration, wherein such one or more stacking features optionally include one or more apertures and/or one or more retaining walls located on the lid component, wherein the one or more apertures on a lid component of an upper storage box in the plurality of open configuration storage boxes are configured to receive the one or more retaining walls on a lid component of a lower storage box in the plurality of open configuration storage boxes.

In another non-limiting object of the invention, there is the provision of a storage box that optionally includes one or more stacking features configured to enable a stacked configuration of a plurality of storage boxes in the open configuration, wherein such one or more stacking features optionally include a ridge extending around at least a portion of a perimeter of the lid component such that the ridge on a lid component of an upper storage box in the plurality of open configuration storage boxes is configured to receive the ridge on a lid component of a lower storage box in the plurality of open configuration storage boxes.

In another non-limiting object of the invention, there is the provision of a storage box that optionally includes one or more stacking features configured to enable a stacked configuration of a plurality of storage boxes in the open configuration, wherein such one or more stacking features optionally enables large numbers (e.g., >10, >20, >30, >40) of storage containers to be stacked vertically such that both the plane of the bottom of the base component of each of the stacked storage boxes are parallel to one another, and the plane of the top surface of the lid component of each of the stacked storage boxes are parallel to one another.

In another non-limiting object of the invention, there is the provision of a storage box that optionally includes one or more stacking features configured to enable a stacked configuration of a plurality of storage boxes in the open configuration, wherein such one or more stacking features optionally allows a first storage box that is stacked on a second storage box such that the base component of the first storage box is partially nested in the cavity of the base component of the second storage box such that about 50-99% of the base component of a first storage box (and all values and ranges therebetween) is nested in the cavity of the base component of the second storage box and simultaneously about 50-99% of the top component of a first storage box (and all values and ranges therebetween) is nested in the cavity of the top component of the second storage box.

In another non-limiting object of the invention, there is the provision of a storage box that optionally includes one or more latch engagement arrangements used to limit or prevent the inadvertent opening of the storage box when in the closed configuration.

In another non-limiting object of the invention, there is the provision of a storage box wherein the lid component optionally includes one or more retaining walls positioned on the interior surface of the lid component such that the one or more retaining walls can optionally be configured to limit movement of the latch mechanism relative to the base component of the storage box in the longitudinal and/or transverse directions.

In another non-limiting object of the invention, there is the provision of a storage box wherein the lid component optionally includes one or more retaining walls positioned on the interior surface of the lid component that are optionally configured such that at least a portion of the one or more retaining walls extends into a portion of the cavity of the base component when the lip component is in the closed configuration.

In another non-limiting object of the invention, there is the provision of a storage box wherein the lid component optionally includes one or more retaining walls positioned on the interior surface of the lid component that are optionally configured such that at least a portion of the one or more retaining walls extends into a portion of the cavity of the base component when the lip component is in the closed configuration such that a portion of an upper edge region of the base component is entrapped between a portion of the one or more retaining walls and a portion of the latch mechanism when the lip component is in the closed configuration, thereby limiting the movement of the lip component relative to the base component when the storage box, thus inhibiting or preventing the latch mechanism on the lid component from disengaging from the base component and allowing the lid component to move from the closed configuration to the open configuration.

In another non-limiting object of the invention, there is the provision of a storage box wherein the lid component optionally includes one or more barbs configured to engage a portion of the base component when the lid component is in the closed configuration.

In another non-limiting object of the invention, there is the provision of a storage box wherein the lid component optionally includes one or more the barbs configured to engage a portion of the base component when the lid component is in the closed configuration wherein the one or more barbs are configured to resist disengaging from the bottom of the rim located on the base component thereby inhibiting or preventing the latch mechanism on the lid component from disengaging from the base component and allowing the lid component to move from the closed configuration to the open configuration.

In another non-limiting object of the invention, there is the provision of a storage box wherein the base component includes one or more stops that limit lateral movement of the latch mechanism on the lid component relative to the base component when the lid component is in the closed configuration.

In another non-limiting object of the invention, there is the provision of a storage box wherein the base component includes one or more stops that limit lateral movement of the latch mechanism on the lid component relative to the base component when the lid component is in the closed configuration, wherein at least two stops are located on an exterior surface of the base component and wherein the two stops are spaced from one another to enable a portion of the latch mechanism on the lid component to fit between the two stops when the latch mechanism engages the base portion to retain the lid component in the closed configuration, and wherein the two stops are configured to limit lateral movement of the latch mechanism relative to the base component when the lid component is in the closed configuration thereby inhibiting or preventing the latch mechanism from disengaging from the base component.

In another non-limiting object of the invention, there is the provision of a method of making a storage box comprising: 1) providing a base component with an open interior and a lid component attached to the base component, wherein the lid component is closed against the base component in a closed configuration and the lid component is moveable with respect to the base component in an open configuration; 2) optionally dividing the interior of the base component into two or more storage areas by forming one or more ridges on a bottom wall of the base component; and, 3) optionally forming one or more channels on an exterior surface of the bottom wall of the base component to provide a recessed grip.

In another non-limiting object of the invention, there is the provision of a method of making a storage box further comprising: providing a plurality of storage boxes in a stacked configuration, wherein each storage box in the plurality is in the open configuration; and forming one or more stacking features on the lid component of each storage box in the plurality of storage boxes.

In another non-limiting object of the invention, there is the provision of a method of making a storage box further comprising engaging the one or more stacking features on a lid component of an upper box in the plurality of storage boxes with the one or more stacking features on a lid component of a lower box in the plurality of storage boxes.

In another non-limiting object of the invention, there is the provision of a method of making a storage box further comprising selecting the one or more stacking features on each lid component in the plurality of storage boxes from at least one of: an indent and a barb, one or more apertures and one or more retaining walls and/or a ridge extending around a perimeter portion of the lid component.

In another non-limiting object of the invention, there is the provision of a storage box comprising: 1) a base component with an open interior; 2) a lid component attached to the base with a hinge; 3) a closed configuration wherein the lid component is closed against the base component and an open configuration wherein the lid component is moveable with respect to the base component; 4) a latch mechanism configured to secure the lid component and the base component in the closed configuration; 5) one or more optional ridges formed in the base component which divide the interior into two or more storage areas; 6) an optional recessed grip on an exterior surface of the base component which is defined by an underside of the one or more ridges; 7) an optional ruler disposed on the exterior surface of the base component, wherein the ruler is comprised of a plurality of indentations formed on the exterior surface of the base component; and, 8) optionally one or more stacking features formed on the lid component.

In another non-limiting object of the invention, there is the provision of a storage box further comprising a plurality of storage boxes in a stacked configuration, wherein each storage box in the plurality is in the open configuration and wherein the one or more optional stacking features on each lid component in the plurality of storage boxes are configured to engage with one another to maintain the stacked configuration of the plurality of storage boxes.

These and other objects and advantages will become apparent from the discussion of the distinction between the invention and the prior art and when considering the preferred embodiment shown in the accompanying drawings.

BRIEF DESCRIPTION OF THE DRAWINGS

Reference may now be made to the drawings, which illustrate various embodiments that the invention may take in physical form and in certain parts and arrangements of parts wherein:

FIG. 1A shows a top perspective view of an exemplary storage box and FIG. 1B shows a bottom perspective view, where the storage box in both FIGS. 1A and 1B is in a closed configuration;

DETAILED DESCRIPTION

Figure 1A:
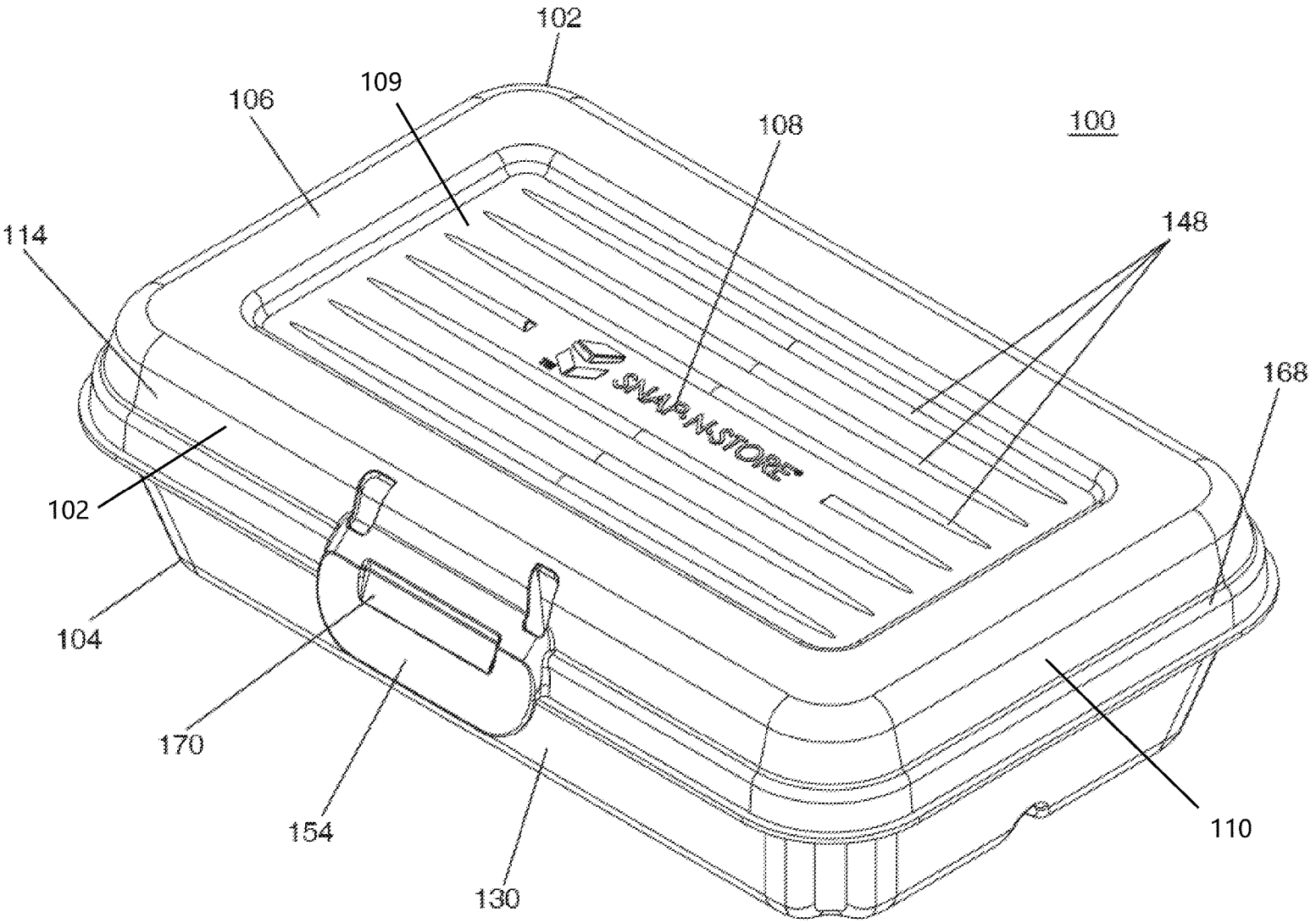
FIGS. 1A and 1B are illustrations according to one non-limiting embodiment of the present disclosure, where

A more complete understanding of the articles/devices, processes, and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" can be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number.

Figure 1B:
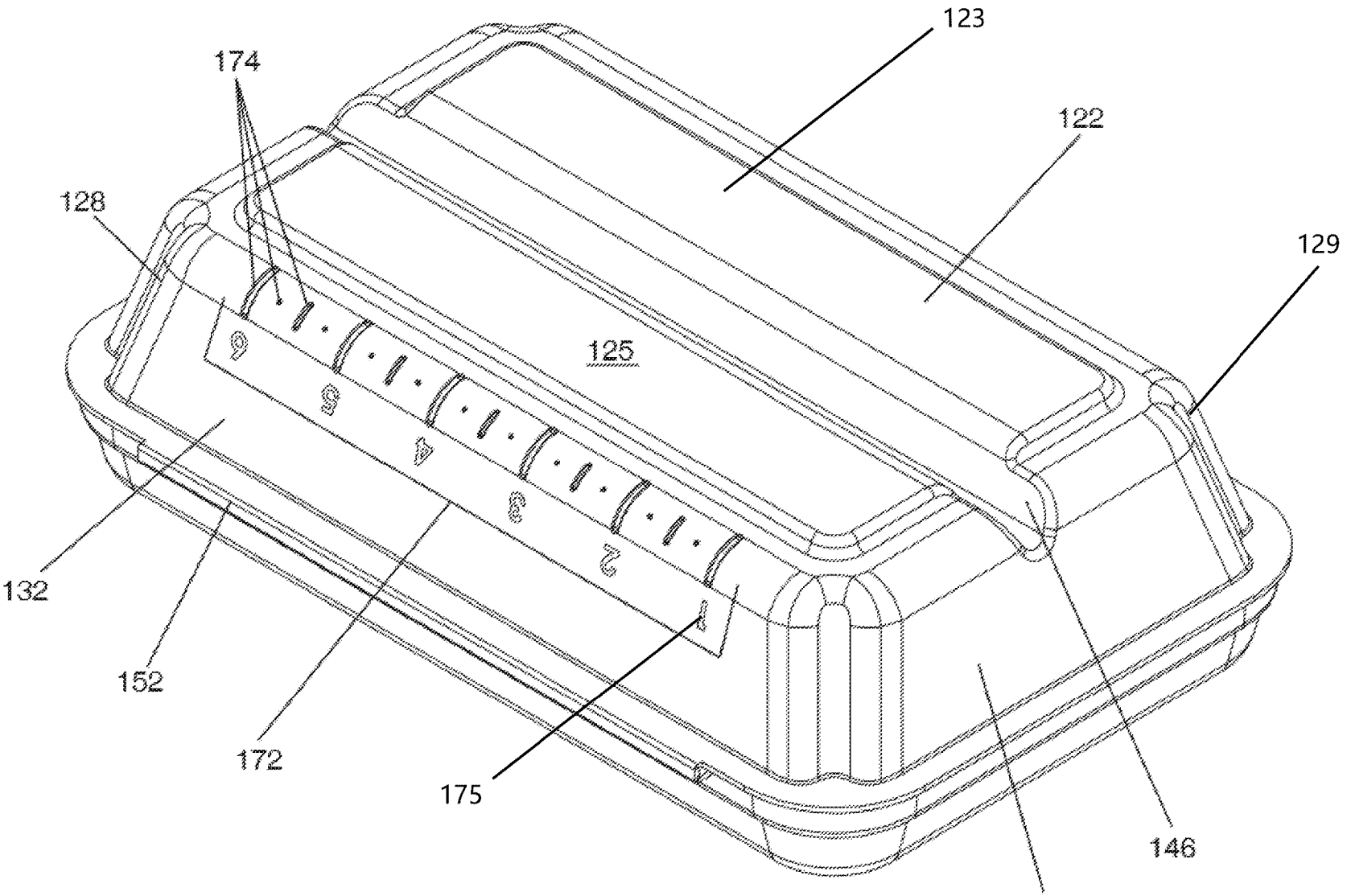
Figure 2:
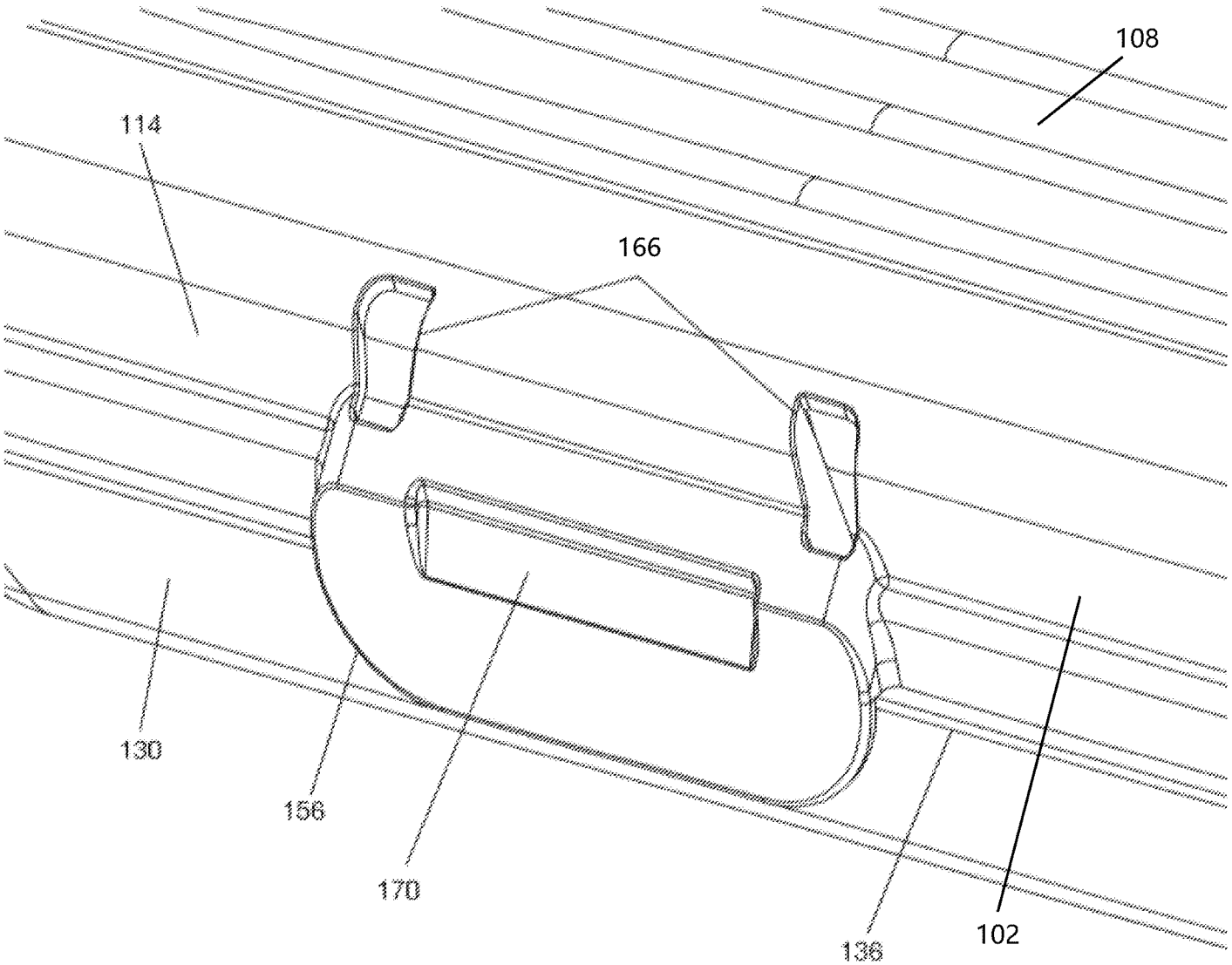
FIG. 2 is a detailed illustration of the storage box illustrated in FIGS. 1A and 1B showing a close-up view of a latch mechanism thereof.
Figure 3:
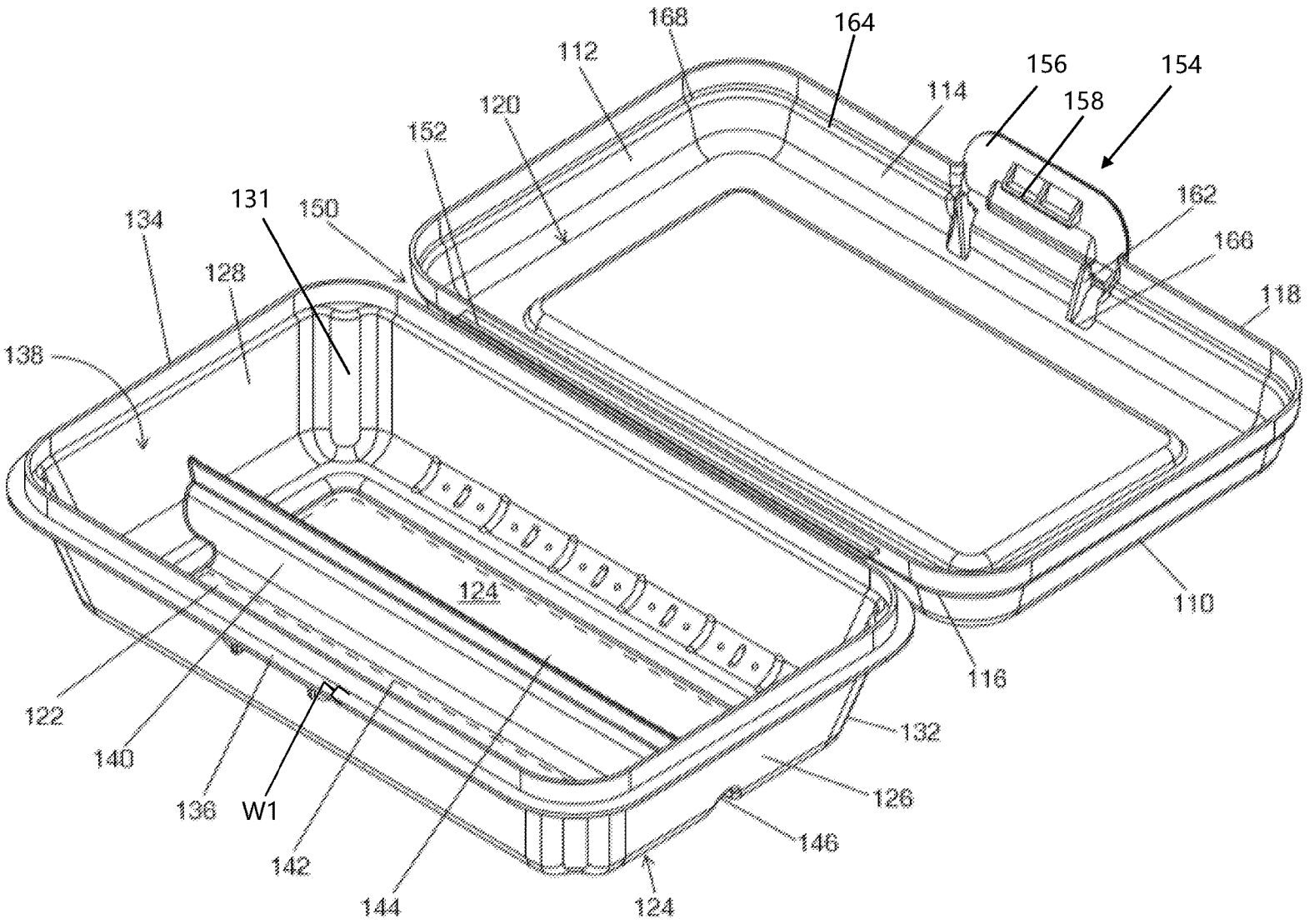
FIG. 3 is a perspective top view of the storage box illustrated in FIGS. 1A and 1B showing the storage box in an open configuration.

Referring now to FIGS. 1-7, there is illustrated a first non-limiting embodiment of a storage box 100. The primary components of the storage box 100 include, but are not limited to, a lid 102 and a base 104. A connection arrangement 150 attaches the lid 102 to the base 104 on at least one side of the lid and base. The lid 102 and base 104 are configurable between an open configuration (as shown in FIG. 3) and a closed configuration (as shown in FIGS. 1A and 1B). The closed configuration is maintained by a latch mechanism 154. The latch mechanism 154 is adapted to temporarily secure the lid 102 to the base 104, generally on the side opposite to the connection means 150; however, such a configuration is non-limiting. The connection arrangement 150 is generally formed of a flexible and/or bendable material (e.g., plastic material, fabric material, etc.).

The hollow interior portion 138 of the base 104 optionally includes a divider 140 configured to separate the interior of the box 100 into two or more interior storage portions. In some non-limiting configurations, when the lid 102 and base 104 are in the closed configuration, the divider 140 is adapted to prevent items stored in one of the two or more interior storage portions from moving into another one of the two or more interior storage portions; however, this is not required. In this regard, the exemplary box 100 advantageously maintains the organization of items stored in the box when in the closed configuration. Generally, the top of the divider 140, when the divider 140 is used, is positioned at or below the base edge 134 of the base 104. As illustrated in FIG. 3, the top of the divider 140 is positioned below the base edge 134 of the base 104. In one non-limiting arrangement, the maximum height of the divider 140 is 10-100% (and all values and ranges therebetween) of the maximum depth of the hollow interior portion 138, and typically about 25-75% of the maximum depth of the hollow interior portion 138.

Additional features of lid 102 and base 104 of the box 100 will now be discussed. The lid 102 illustrated in FIGS. 1-7 has a generally rectangular shape. However, the shape of the lid 102 is non-limiting and the lid 102 can have any desired shape without departing from the scope of the present disclosure. The lid 102 is generally comprised of a top wall 106 with a top wall surface 108, first and second sidewalls 110 and 112, and front and back walls 114 and 116. A lid edge 118 outlines a lid perimeter defined by the bottoms of walls 110, 112, 114, and 116. The lid 102 provides a hollow interior portion 120.

The base 104 is illustrated in FIGS. 1-7 as having a generally rectangular shape similar to lid 102; however, the particular shape of the base 104 is non-limiting and the base can have any desired shape without departing from the scope of the present disclosure. The base 104 is generally comprised of a bottom wall 122 with a bottom wall surface 123, first and second sidewalls 126 and 128, and front and back walls 130 and 132. A base top edge 134 outlines a top perimeter of the base 104 that is generally defined by the tops of walls 126, 128, 130, and 132. The base 104 provides a hollow interior portion 138. An outwardly extending flange or rim 136 is disposed around substantially the entire perimeter of the base 104 adjacent to the tops of walls 126, 128, 130, and 132. The outwardly extending flange or rim 136 is generally positioned below the base top edge 134. Generally, the outwardly extending flange or rim 136 is generally positioned closer to the base top edge 134 than to the bottom wall surface 123.

An optional divider 140 is formed in the interior surface 124 of the bottom wall 122 and extends into the hollow interior portion 138 of the base 104, thereby dividing the base interior into two or more interior portions, such as first interior portion 142 and second interior portion 144. However, such a configuration is non-limiting, and it should be understood that divider 140 can optionally divide the interior portion 138 of the base 104 into any desired number of interior portions without departing from the scope of the present disclosure.

As illustrated in FIG. 1B, the storage box 100 includes an optional ruler 172. While the specific location of the ruler 172 on the storage box 100 is non-limiting, the ruler 172 is typically disposed on an exterior surface of one of the walls of the base or lid. For example, in the non-limiting configuration shown in FIG. 1B, the ruler 172 is on the exterior of back wall 132 of the base 104 and disposed adjacent a lower portion thereof. In this regard, it is generally advantageous to position the ruler 172 near the lower portion of the base so that items on the same surface as the base can easily be measured. Moreover, while the upper measurable length limit of ruler 172 is non-limiting, the total measurable length is generally directly proportional to the size of the storage box 100. For example, large storage boxes could accommodate a ruler which measures up to 12 in. or more, medium storage boxes could accommodate a ruler which measures up to 6-8 in., and small storage boxes could accommodate a ruler which measures up to 3-4 in.

The ruler 172 is also illustrated in FIG. 1B as generally being comprised of a plurality of indentations 174 or other demarcations formed on or into the exterior surface of the base 104. As can be appreciated, the ruler 172 can be formed of raised ribs or other raised demarcations, or a combination of indentions and raised positions. The plurality of indentations 174 are spaced apart from one another at distances representative of any desirable customary system of measuring length. For example, in one non-limiting configuration, the plurality of indentations 174 of the ruler 172 are spaced according to the United States customary system for measuring length. However, other measurement systems (e.g., metric) could also be used. In some non-limiting configurations, the size of individual indentations in the plurality of indentations 174 can correspond to the number type and value that each individual indentation represents. For example, the large elongated indentations in the plurality 174 correspond to whole number measurement intervals (e.g., 1 in., 1 cm, etc.), the small elongated indentations correspond to half-number/smaller unit measurement intervals (e.g., ½ in., ½ cm, etc.), and the small circular indentations correspond to fractional number/smaller unit measurement intervals (e.g., ¼ in., 1 mm, etc.). The ruler 172 can optionally include numerical units 175.

As mentioned above, the optional divider 140 is formed in the interior surface 124 of the bottom wall 122 and is generally not attached thereto as a separate component. In other words, the divider 140 and base 104 are generally formed as a single, integral component. In this regard, with respect to the interior portion 120 of the base 104, the divider 140 can also be described as one or more raised ridge portions configured to divide the base interior into two or more interior portions. With respect to the exterior surface 125 of the bottom wall 122, however, the divider 140 can be described as one or more recessed channel portions 146. The one or more recessed channel portions 146 can optionally be configured to provide a grip into which a user of the box 100 can place his or her fingers to more securely grasp the box. In other words, the underside of the divider 140 (i.e., the one or more raised ridge portions) provides the recessed grip 146 (i.e., the one or more recessed channels) on the exterior surface 125 of the bottom wall 122. Moreover, since the divider 140 is generally formed integrally with the base, the recessed grip 146 can also be described as being formed integrally with the base. The surface 108 of the top wall 106 can also optionally be provided with one or more surface features 148 configured to provide additional grip for a user of the box 100. For example, the one or more surface features 148 can include a series of raised ridges formed on the top wall surface 108 of the lid 102. However, such a configuration is non-limiting. As illustrated in FIG. 1A, the one or more surface features 148 are optionally located in a recessed portion 109. When a recessed portion 109 is used, the walls of the recessed portion 109 can also function as a gripping surface to facilitate in the grasping of the box 100. When the one or more surface features 148 are located in the recess portion 109, the height of the one or more surface features 148 generally does not exceed the depth of the recess portion 109, and is generally less than the depth of the recess portion 109 as illustrated in FIG. 1A.

The lid 102 and base 104 are attached to one another such that the box 100 is configurable between the open configuration illustrated in FIG. 3 and the closed configuration illustrated in FIGS. 1A and 1B. For example, a connection arrangement 150 is disposed between at least one of the lid walls 110, 112, 114, and 116 and at least one of the base walls 126, 128, 130, and 132. As best illustrated in FIG. 3, the connection arrangement 150 can comprise a flexible and/or bendable hinge 152 rotatably connecting the back wall 116 of the lid 102 to the back wall 132 of the base 104, such that the lid is moveable with respect to the base in the open configuration; however, such a configuration is non-limiting.

A latch mechanism 154 is configured to temporarily or releasably secure one side of the lid 102 to the base 104. The latch mechanism 154 is generally disposed on a lid wall and/or a base wall that are opposite to the lid and base wall where the connection means 150 is disposed. As illustrated in FIGS. 1A-1B, 2, and 3, the latch mechanism 154 can be located on front wall 114 of the lid 102; however, such a configuration is non-limiting. In some non-limiting embodiments, the latch mechanism 154 can be integrally formed with/on the front wall 114 of the lid 102.

Figure 4:
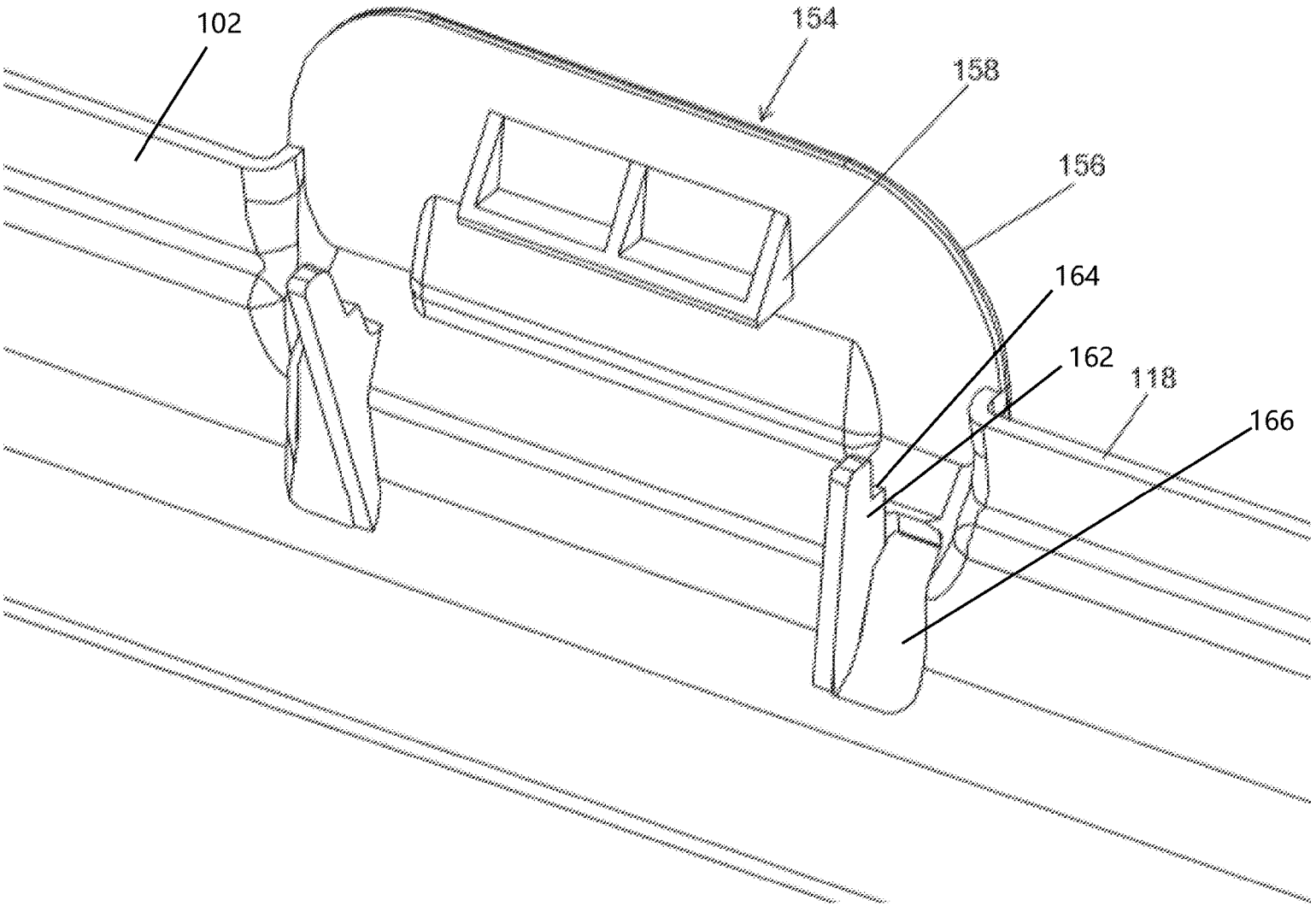
FIG. 4 is a detailed illustration of the storage box illustrated in FIGS. 1A and 1B showing a close-up view of a resiliently biased tab member of the latch mechanism illustrated in FIG. 2.

In one non-limiting configuration, as best illustrated in FIGS. 2-5, the latch mechanism 154 includes a resilient member or tab 156 formed on the front wall of the lid 102. The resilient member or tab 156 of the latch mechanism 154 is configured to interact with a component of the base 104. In some non-limiting embodiments, the resilient member or tab 156 includes a generally wedge-shaped barb 158 located on the inner surface of the resilient member or tab 156 that is configured to interact with the flat, outwardly extending rim 136 of the base 104; however, it will be appreciated that the barb 158 can have other shapes. The barb 158 can be integrally formed on the lid 102 or be connected to the lid 102 by a connector (e.g., adhesive, pin, staple, melted seam, solder, rivet, etc.). Generally, the surface of the barb 158 that is configured to engage the base 104 so as to temporarily or releasably secure one side of the lid 102 to the base 104 has a generally flat surface; however, this is not required. The width W of the generally flat surface of the barb 158 is generally selected to inhibit or prevent inadvertent opening of the lid 102 when the lid 102 is in the closed configuration. In one non-limiting specific design, the width W of the generally flat surface of the barb 158 is about 20-100% (and all values and ranges therebetween) of the width W1 of the outwardly extending rim 136 of the base 104 where the barb 158 is configured to engage the outwardly extending rim 136 when the lid 102 is in the closed configuration, typically the width W of the generally flat surface of the barb 158 is about 30-80% of the width W1 of the outwardly extending rim 136 of the base 104 where the barb 158 is configured to engage the outwardly extending rim 136 when the lid 102 is in the closed configuration, and more typically, the width W of the generally flat surface of the barb 158 is about 40-70% of the width W1 of the outwardly extending rim 136 of the base 104 where the barb 158 is configured to engage the outwardly extending rim 136 when the lid 102 is in the closed configuration. The length of the barb 158 is generally the same or less than the length of the resilient member or tab 156. As illustrated in FIGS. 3-4, the length of the barb 158 is less than the length of the resilient member or tab 156. As also illustrated in FIGS. 3-4, the barb 158 is generally spaced from the bottom edge of the resilient member or tab 156; however, this is not required.

Figure 5:
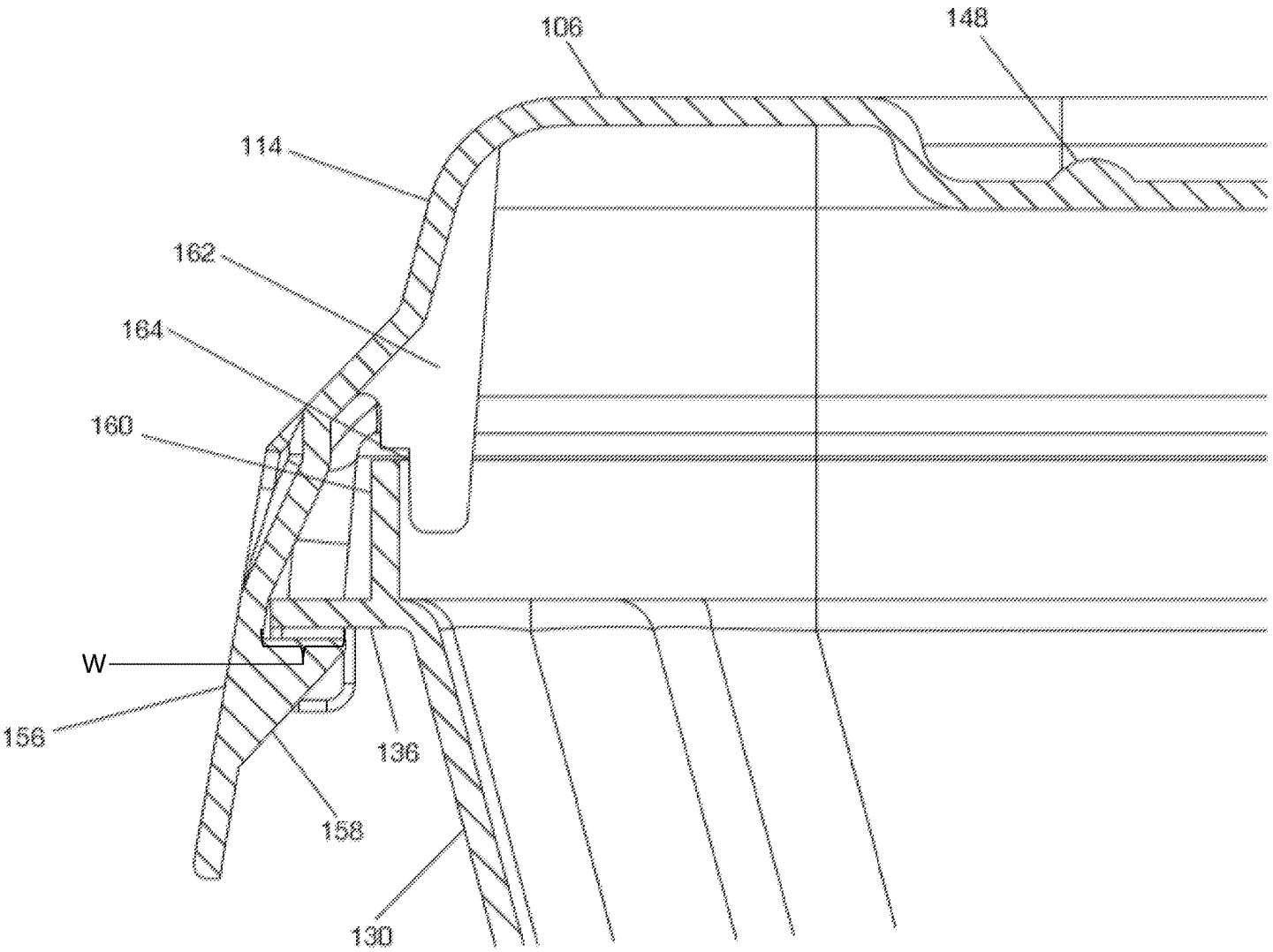
FIG. 5 is a partial cross-sectional side view of the storage box illustrated in FIGS. 1A and 1B showing a detailed view of the latch mechanism when the storage box is in a closed configuration.

With reference to FIGS. 3-5, the closing of the lid 102 against the base 104 from the open configuration to the closed configuration is achieved by pushing the lid and resilient member or tab 156 downward and against the outwardly extending rim 136 until the barb 158 engages or snaps into place against the bottom of the outwardly extending rim 136. Thus, when the box 100 is in the closed configuration, barb 158 is latched against the bottom of the outwardly extending rim 136, thereby temporarily securing the lid 102 against the base 104. The resilient member or tab 156 is generally configured to be a deformable or flexible component such that when barb 158 contacts the outwardly extending rim 136 as the lid 102 is moved to the closed configuration, the resilient member or tab 156 is configured to deform or flex outwardly to enable the barb 158 to pass over the outer edge of the outwardly extending rim 136. Once barb 158 has passed over the outer edge of the outwardly extending rim 136, the resilient member or tab 156 is configured to move back to its pre-deformed or pre-flexed shape, thereby causing a portion of the barb 158 to move under a portion of the outwardly extending rim 136 to thereby secure the lid 102 in the closed configuration. When the lid 102 is to be moved from the closed configuration to the open configuration, a user merely needs to pull the resilient member or tab 156 forwardly to cause the resilient member or tab 156 to deform or flex outwardly so that the lid 102 can be pivoted upwardly and the barb 158 can passed over the outer edge of the outwardly extending rim 136.

A stop wall 160 disposed on the rim 136 and one or more corresponding retaining walls 162 disposed on the lid 102 are configured to prevent the lid 102 from over-extending past the base 104 in both the longitudinal and transverse directions. The stop wall 160 is generally spaced away from the distal edge of the rim 136 and toward the interior portion 138 of the base 104; however, this is not required. The stop wall 160 is oriented generally perpendicular to the rim such that the stop wall and rim form an L-shape; however, this is not required. The stop wall 160 extends upward from the rim 136 to interact with the one or more retaining walls 162 disposed in the interior portion 120 of the lid 102. The one or more retaining walls 162 generally extend from the top wall 106 and along the front wall 114 of the lid 102.

The one or more retaining walls 162 optionally include a notch 164 that is configured to act as stop to lid 102. If too much pressure is exerted on lid 102, the top edge of stop wall 160 will engage notch 164 to inhibit or prevent further downward movement of the lid 102 onto the base 104 when the lid 102 is moved to the closed configuration. The depth of the notch 164 from the lid edge 118 is generally equal to or greater than the height the stop wall 160 (e.g., 100-150% the height the stop wall 160). The width of the notch 164 is generally 50-250% (and all values and ranges therebetween) the thickness of the stop wall 160.

The one or more retaining walls 162 are thus configured to stabilize the front wall 114 of the lid 102 and keep the barb 158 secured to the rim 136 of the base 104.

The engagement of the stop wall 160 against the notch(es) 164 facilities in inhibiting or preventing the lid 102 from moving excessively downward in the longitudinal direction and from moving excessively sideways in the transverse direction. This longitudinal and transverse movement is inhibited or prevented both during the securing of the lid 102 to the base 104 and after the latch mechanism 154 has secured the lid 102 to the base 104 in the closed configuration. For example, in a situation where a user accidentally drops the box 100, the engagement of the stop wall 160 against the notch(es) 164 of the one or more retaining walls 162 helps inhibit or prevent the lid 102 from moving in the longitudinal and/or transverse direction to such a degree that the integrity of the latch mechanism 154 might otherwise be comprised, which could result in the unintended opening of the box 100 from the closed configuration to the open configuration. On the other hand, intentional opening of the box 100 from the closed configuration to the open configuration is achieved by pulling on the resilient member or tab 156 until the barb 158 disengages from the bottom of the rim 136, at which point the lid 102 can rotate or pivot freely about the hinged connection 152 to open the box 100.

Figure 11:
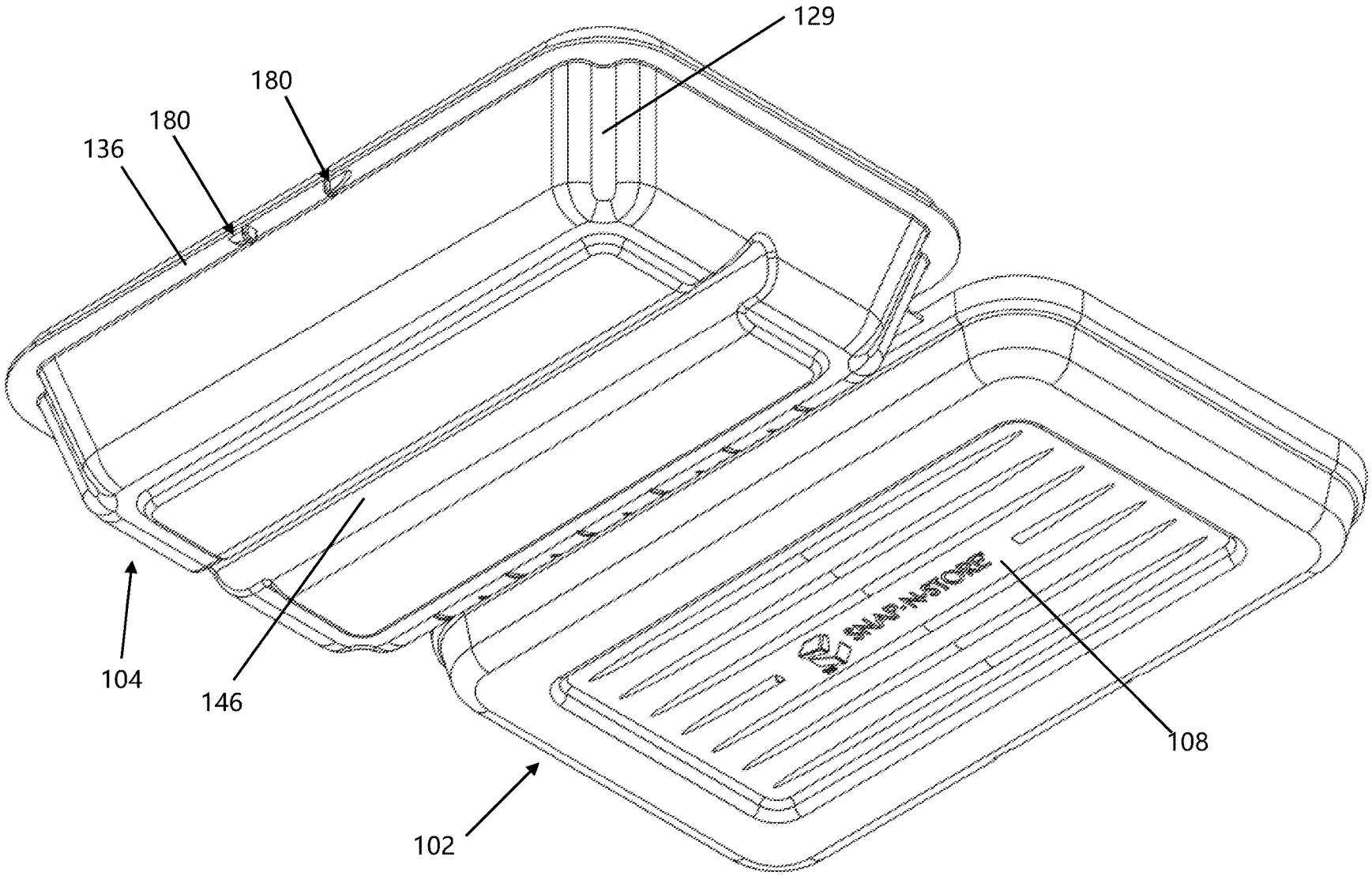
FIG. 11 is a perspective bottom view of the storage box illustrated in FIG. 10 which shows the storage box in an open configuration; and, FIG. 12 is an enlarged view of the stops and latch mechanism illustrated in FIG. 10.
Figure 12:
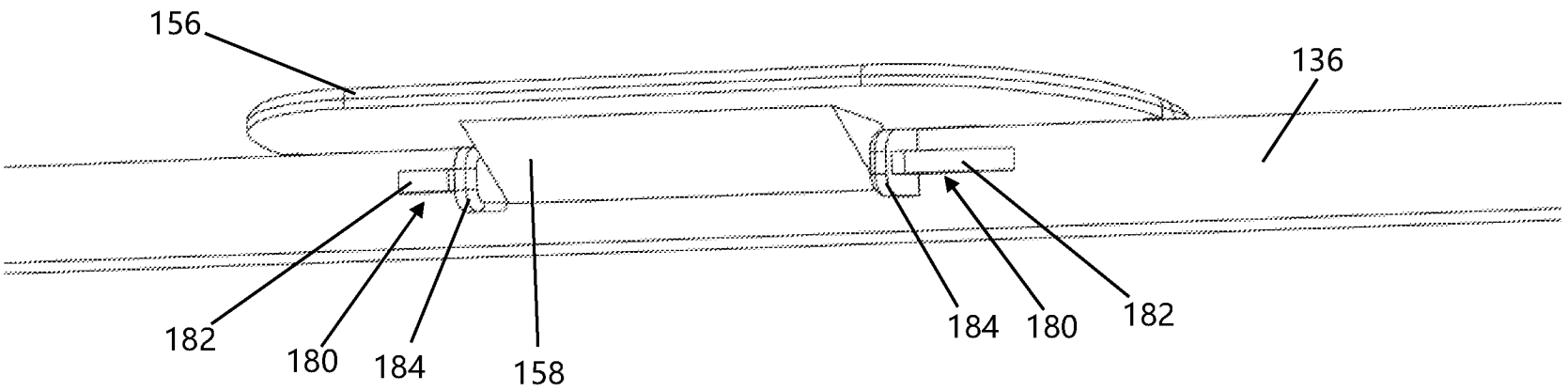

As illustrated in FIGS. 11-13, the box 100 can optionally include one or more latch stops 180 used to limit the lateral movement of the barb 158 relative to the rim 136 when the lid 102 is in the closed configuration. The limiting or prevention of the lateral movement of the barb 158 relative to the rim 136 helps inhibit or prevent the lid 102 and/or the barb 158 from moving in the longitudinal and/or transverse direction to such a degree that the integrity of the latch mechanism 154 might otherwise be compromised, which could result in the unintended opening of the box 100 from the closed configuration to the open configuration. The latch stops 180 can also or alternatively be used to properly orient the lid 102 and/or latch mechanism 154 relative to the base 104 when moving the lid 102 to the closed position. Generally, the one or more latch stops 180 are positioned on rim 136; however, it can be appreciated that a portion or all of the one or more latch stops 180 are positioned on the front surface of the base wall.

As best illustrated in FIG. 12, the box 100 includes two latch stops 180 that are spaced from one another and positioned on rim 136. The spacing between the two latch stops 180 is sufficient to enable a portion of the barb 158 to be positioned between the two latch stops 180 when the lid 102 is in the closed configuration. Generally, the spacing between the two latch stops 180 is 100-150% (and all values and ranges therebetween) the length of the portion of the barb 158 that is to be positioned between the two latch stops 180 when the lid 102 is in the closed configuration, and typically 101-130% the length of the portion of the barb 158 that is to be positioned between the two latch stops 180 when the lid 102 is in the closed configuration, and more typically 101-110% the length of the portion of the barb 158 that is to be positioned between the two latch stops 180 when the lid 102 is in the closed configuration.

The latch stop 180 includes a stop wall 184 and an optional wall reinforcement 182. The stop wall extends downwardly from the rim 136. The size and configuration of the stop wall 184 is non-limiting. The front surfaces of each of the two stop walls 184 that are facing one another are generally flat; however, this is not required. The height of the stop wall 184 is non-limiting. The back surfaces of each of the two stop walls 184 are connected to an optional wall reinforcement 182. The optional wall reinforcement 182 is configured to provide support and/or structural rigidity to the stop wall 184. The size and configuration of the optional wall reinforcement 182 is non-limiting. As illustrated in FIG. 13, the optional wall reinforcement 182 is located on the rim 136 and slopes downwardly from the stop wall 184.

Figure 6:
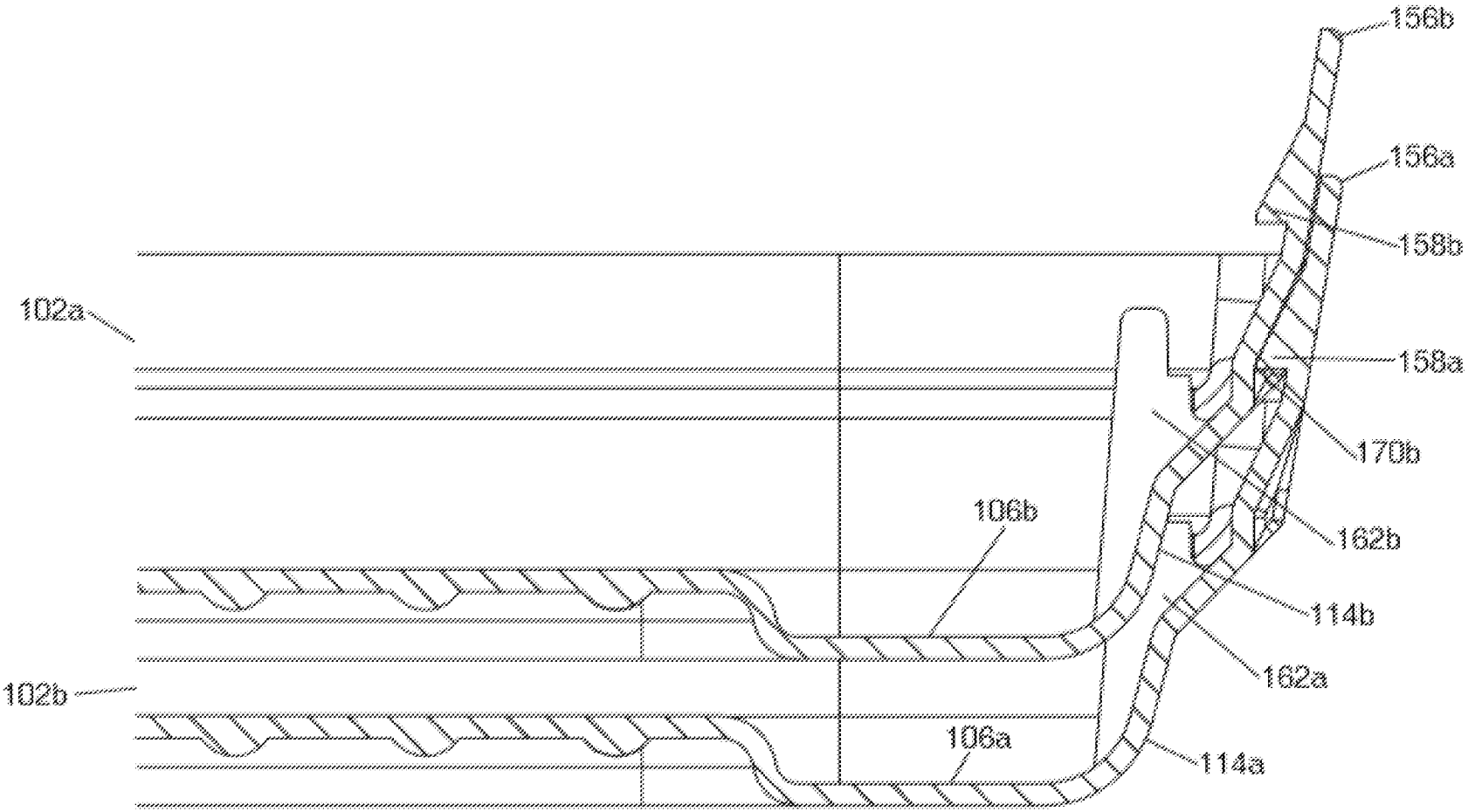
FIG. 6 is an illustration according to one non-limiting aspect of the present embodiment showing a partial cross-sectional side view of two storage boxes having the features of the storage box illustrated in FIGS. 1A and 1B wherein the two storage boxes are in a stacked/nested configuration.
Figure 7:
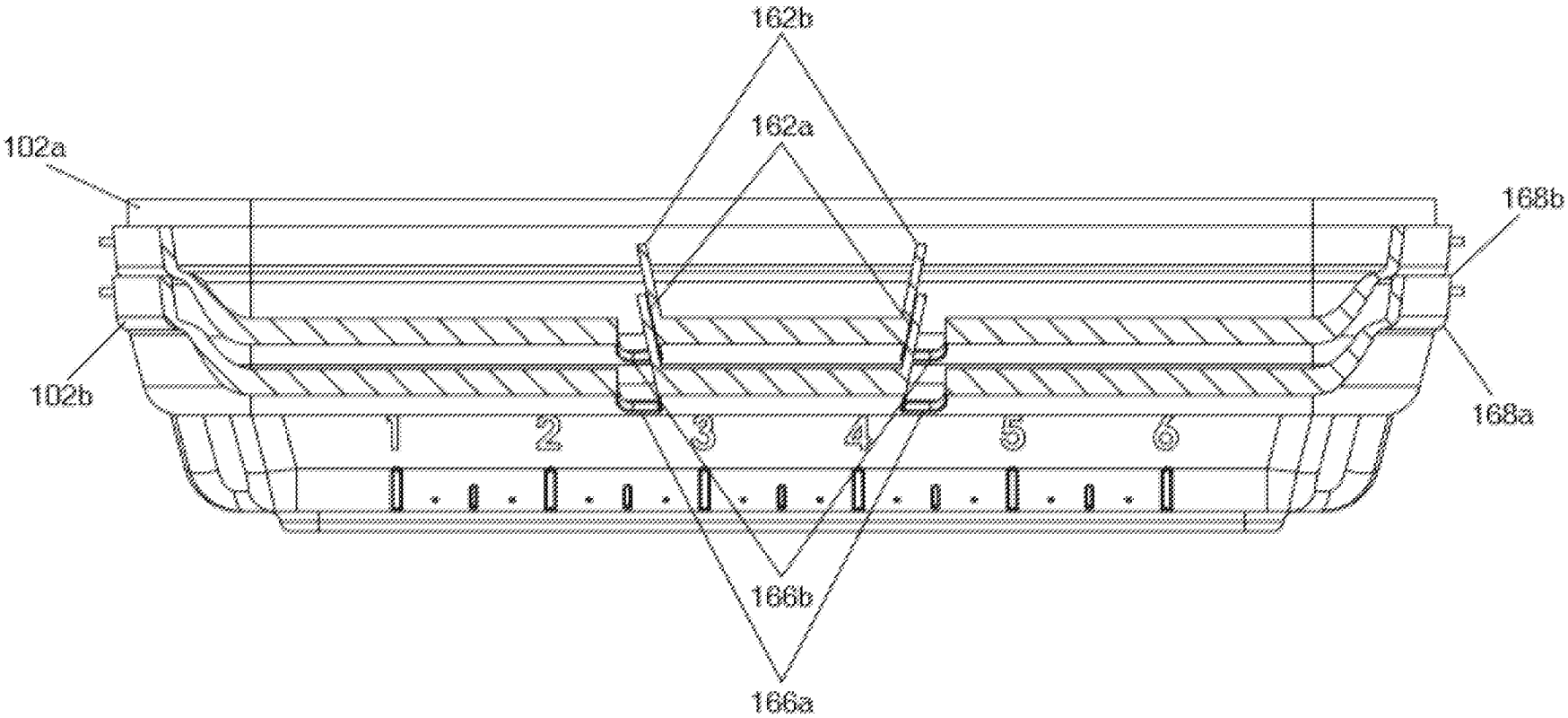
FIG. 7 is an illustration showing another view of the two storage boxes from FIG. 6.
Figure 8:
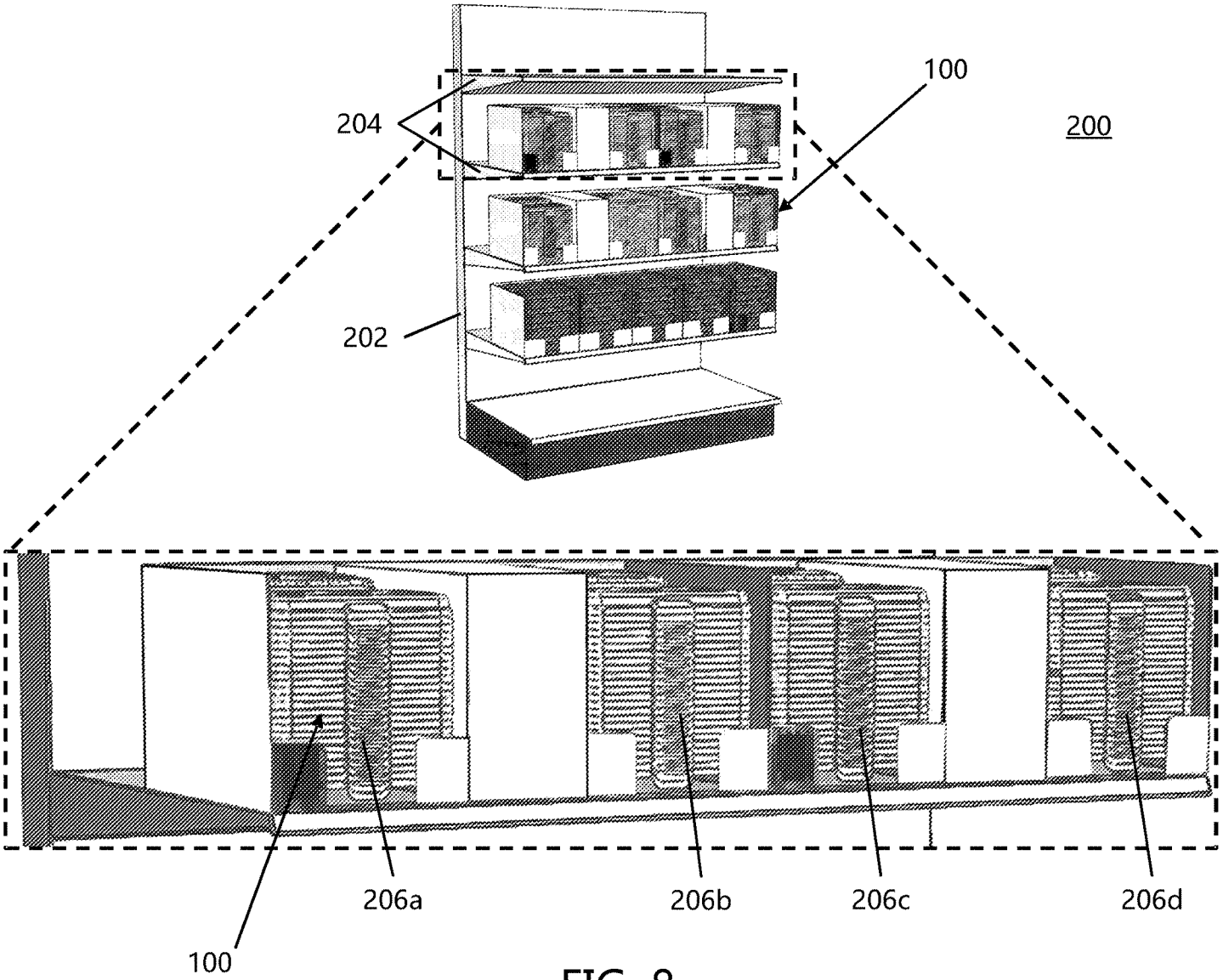
FIG. 8 is an illustration according to another non-limiting embodiment of the present disclosure wherein a plurality of storage boxes are in a stacked configuration on storage shelves, each having the features of the storage box illustrated in FIGS. 1A and 1B.
Figure 9:
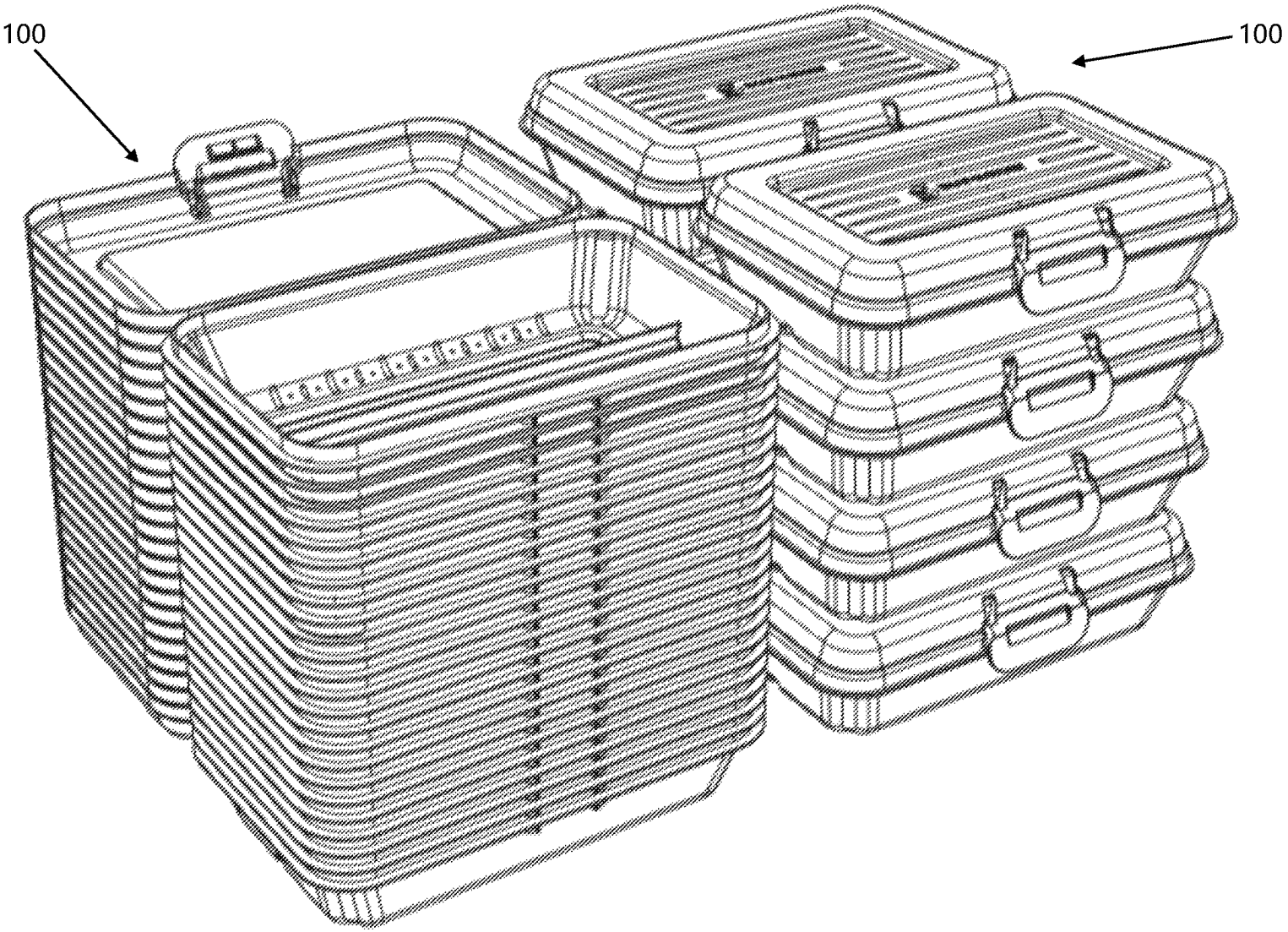
FIG. 9 is an enlarged view of a plurality of storage boxes in a stacked configuration.
Figure 10:
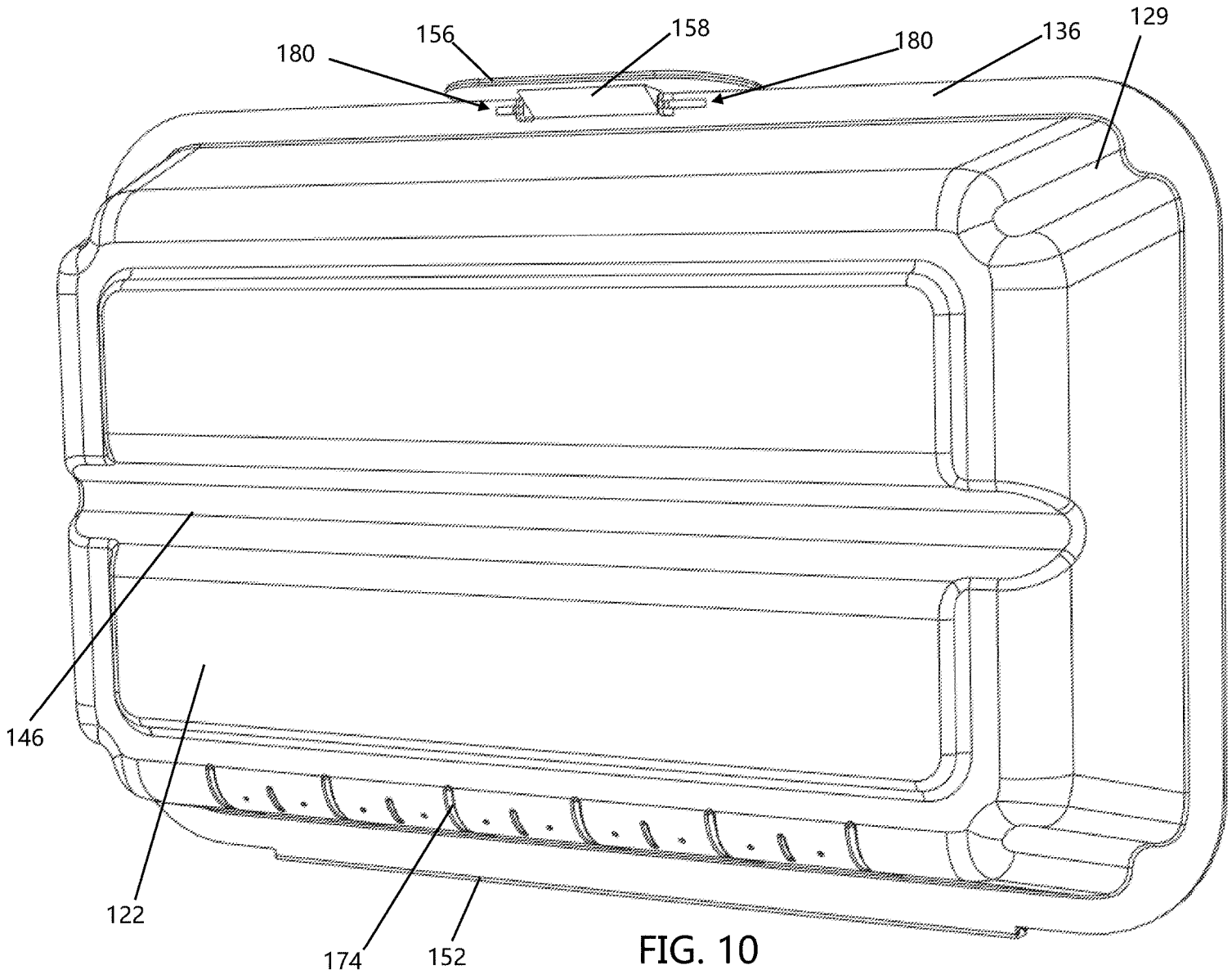
FIG. 10 a bottom perspective view of the storage box of FIGS. 1-7 which includes stops to limit movement of the latch mechanism when the storage box is in the closed configuration.

In accordance with another aspect of the present disclosure, the exemplary storage box 100 includes one or more features which allow for the stacking of a plurality of storage boxes in the open configuration. Referring now to FIGS. 6-7, there are illustrated two storage boxes in a stacked or nested configuration, where lids 102*a* and 102*b* are shown in stacked relation to one another. As another example, FIGS. 8-9 illustrates a stack 200 of 10+ storage boxes 100 in a stacked or nested configuration, where multiple stacks 206*a*-206*d* of storage boxes 100 are shown on a shelf unit 202. When a plurality of storage boxes 100 is provided, the one or more stacking features are generally configured to interact and engage with one another to enable stacking in a stable, space-saving manner. That is, with a plurality of storage boxes 100, generally the one or more stacking features on an upper lid (such as upper lid 102*a* in FIGS. 6 and 7) in a stack of boxes (such as box stacks 206*a*-206*d* in FIG. 8) are configured to engage with the one or more stacking features on a lower lid (such as lower lid 102*b* in FIGS. 6 and 7) in the stack of boxes. Various non-limiting embodiments of the one or more stacking features are discussed in greater detail below. A novel feature of the one or more stacking features used in each of the storage box 100 is that the stacked storage boxes 100 can be stacked to form a vertical tower of stacked storage boxes 100 as illustrated in FIG. 9. FIG. 9 illustrates a set of storage boxes 100 stacked while in the open configuration, and a set of storage boxes 100 stacked while in the closed configuration. When prior art storage boxes do not include stacking features, the storage boxes must be stacked while in the closed position. Such a stacking arrangement significantly limits the number of stacked storage boxes that can be positioned on a certain volume of shelf space. As illustrated in FIG. 9, eight stacked storage boxes 100 stacked while in the closed configuration takes up the same shelf volume as 24 storage boxes 100 stacked while in the open configuration, or in this non-limiting example, three times as many storage boxes 100 stacked while in the open configuration can be positioned on a shelf of a certain volume than when the storage boxes 100 are stacked while in the closed configuration. Such a space savings is a significant advantage in the retail market where shelf space is limited. As can be appreciated, most prior art storage boxes can be stacked in some form while in the open position; however, such stacking of more than two-to-eight prior art storage boxes typically results in 1) an unstable tower and/or unstable leaning tower of prior art stacked boxes that is prone to fall thereby potentially damaging the prior art storage boxes and/or resulting in the stacked prior art storage boxes falling off of the shelves, and/or 2) aesthetically displeasing presentation of the prior art stacked boxes in the shelves thereby resulting in perceived lower quality and/or reduced sales of the prior art storage boxes. The unstable tower and/or unstable leaning tower of prior art stacked boxes is a result of the base and/or lid of the prior art storage boxes not being able to be both stacked such that the planes of bases of the prior art stacked storage boxes are parallel to one another and the planes of the lids of the prior art stacked storage boxes are parallel to one another. If either or both of the bases and the lids can be stacked such that the planes are parallel to adjacently prior art stacked storage boxes, the stacked prior art storage boxes begin to form a leaning tower of stacked prior art storage boxes until the center of gravity of the stacked prior art storage boxes shifts a significant amount off-center from the bottom prior art storage boxes to cause the stacked tower to become unstable and fall. The stacking features of the storage boxes in accordance with present disclosure overcome these past stacking problems associated with prior art storage boxes and results in 1) enabling 10+ storage boxes 100 to be stacked vertically while in the open configuration without resulting in an unstable and/or leaning tower of stacked boxes, and 2) creates a clean nesting profile of the stacked storage boxes 100 while in the open configuration to create an aesthetically pleasing presentation of the stacked storage boxes 100. As illustrated in FIGS. 6-9, the bottom surface 122 of the base 104 of each of the stacked boxes 100 lies in a plane that is parallel to one another. This allows the base 104 of each of the stacked boxes 100 to be stacked vertically without causing a leaning tower of boxes.

As best illustrated in FIGS. 6 and 9, the base 104 of each of the stacked boxes 100 is configured to enable the base 104 of an adjacently stacked box 100 to nest such that 30-99% (and all values and ranges therebetween) of the volume of the base 104 of the adjacently stacked box 100 is able to nest in the stacked box 100 that is positioned below the adjacently stacked box 100, typically each of the stacked boxes 100 is configured to enable the base 104 of an adjacently stacked box 100 to nest such that 50-95% of the volume of the base 104 of the adjacently stacked box 100 is able to nest in the stacked box 100 that is positioned below the adjacently stacked box 100, and more typically each of the stacked boxes 100 is configured to enable the base 104 of an adjacently stacked box 100 to nest such that 60-95% of the volume of the base 104 of the adjacently stacked box 100 is able to nest in the stacked box 100 that is positioned below the adjacently stacked box 100.

Also, as best illustrated in FIGS. 6 and 9, the base 104 of each of the stacked boxes 100 is configured to enable the lid 102 of an adjacently stacked box 100 to nest such that 20-99% (and all values and ranges therebetween) of the volume of the lid 102 of the adjacently stacked box 100 is able to nest in the stacked box 100 that is positioned below the adjacently stacked box 100, typically each of the stacked boxes 100 is configured to enable the base 104 of an adjacently stacked box 100 to nest such that 30-90% of the volume of the lid 102 of the adjacently stacked box 100 is able to nest in the stacked box 100 that is positioned below the adjacently stacked box 100, and more typically each of the stacked boxes 100 is configured to enable the lid 102 of an adjacently stacked box 100 to nest such that 40-85% of the volume of the lid 102 of the adjacently stacked box 100 is able to nest in the stacked box 100 that is positioned below the adjacently stacked box 100.

In one non-limiting configuration, the one or more stacking features on the lid 102 include one or more apertures 166 (best shown in FIG. 2). The apertures 166 are generally located on the top and front walls 106, 114 of the lid 102 and extend therethrough into the interior portion 120. In such configurations, the storage box 100 includes the one or more retaining walls 162 as discussed above; the apertures 166 are configured to receive a portion of the one or more retaining walls 162 of an adjacently stacked storage box so that the lids 102 of the adjacently stacked storage boxes can lie in planes parallel to one another as illustrated in FIG. 6. As best shown in FIG. 3, the retaining walls 162 are generally disposed adjacent to the apertures 166. In the context of a plurality of storage boxes in a stacked configuration, the apertures of an upper lid (e.g., apertures 166*b* of upper lid 102*b* shown in FIG. 7) in the stack are configured to engage with the retaining walls of a lower lid (e.g., retaining walls 162*a* of lower lid 102*a* shown in FIGS. 6 and 7). More particularly, at least a portion of the retaining walls 162*a* of lower lid 102*a* extend up through the apertures 166*b* of upper lid 102*b*, such that the portions of the upper lid wall which are adjacent to the apertures rest on and are supported by the retaining walls. As such, a plurality of storage boxes can be maintained in a stacked configuration in a stable, space-saving manner. Since the lower lid 102*a* in FIGS. 6 and 7 belongs to the last storage box in the stack, the apertures 166*a* of the lower lid 102*a* do not have retaining walls extending therethrough.

In another non-limiting configuration, the one or more stacking features include a wall ridge 168 extending around at least a portion of the perimeter of the lid 102 in a horizontal fashion. As best seen in FIGS. 1A and 3, the wall ridge 168 is generally formed on at least one of the lid walls 110, 112, 114, 116 such that a ridge is provided on both the interior portion 120 and the exterior portion of the lid 102. The lid walls 110, 112, 114, 116 positioned at or below the wall ridge 168 slope slightly inwardly to facilitate in the nesting of the stacked lids 102. If the lid walls 110, 112, 114, 116 positioned at or below the wall ridge 168 did not slope slightly inwardly, improper stacking of the lids 102 could occur.

In the context of a plurality of storage boxes in a stacked configuration, the ridge on an upper lid (e.g., ridge 168*b* of upper lid 102*b* shown in FIG. 7) in the stack is configured to engage with the ridge of a lower lid (e.g., ridge 168*a* of lower lid 102*a* shown in FIG. 7). More particularly, the upper lid 102*b* is shaped to fit or partially nest inside the lower lid 102*a* such that the ridge 168*b* of the upper lid can rest on and be supported by the ridge 168*a* of the lower lid. As such, a plurality of storage boxes can be maintained in a stacked configuration in a stable, space-saving manner.

In an additional non-limiting configuration, the one or more stacking features optionally include an indent 170 disposed on the lid 102. As best seen in FIG. 2, the indent 170 is generally located on the exterior of the resilient member or tab 154. However, the specific location of the indent 170 is non-limiting. In such configurations, the one or more stacking features also include the wedge-shaped barb 158 discussed above with respect to the closing of the lid into the closed configuration. Generally, the barb 158 and indent 170 are disposed on opposing sides of a wall of the lid 102, such as front wall 114. In the context of a plurality of storage boxes in a stacked configuration, the indent of an upper lid (e.g., indent 170*b* of upper lid 102*b* shown in FIG. 6) in the stack of boxes is configured to engage with the barb of a lower lid (e.g., barb 158*a* of lower lid 102*a* shown in FIG. 6). More particularly, the barb 158*a* of the lower lid 102*a* is shaped to fit at least partially within the indent 170*b* of the upper lid 102*b*, such that the barb of the lower lid can rest on and be supported within the indent of the upper lid. As such, a plurality of storage boxes can be maintained in a stacked configuration in a stable, space-saving manner.

In an additional non-limiting configuration, the one or more stacking features include inwardly sloped first and second sidewalls 126 and 128, and inwardly sloped front and back walls 130 and 132 on the base 104. As best illustrated in FIGS. 3 and 5, the inward slope of the walls generally begins at or below the outwardly extending flange or rim 136. If the base walls 126, 128, 130, 132 positioned at or below outwardly extending flange or rim 136 did not slope slightly inwardly, improper stacking of the bases 104 could occur.

In an additional non-limiting configuration, the one or more stacking features include recessed channel portions 146 when the base 104 includes a divider 140. When a plurality of bases 104 are stacked together, the recessed channel portions 146 of a base 104 that is stacked on top of another base 104 is configured to receive at least a portion of the divider 140 on the below base 104 such that stacked bases 104 can be properly nested together. If the base 104 includes a divider 140 but is absent a recessed channel portions 146 that is configured to receive the divider 140, improper stacking of the bases 104 could occur.

In an additional non-limiting configuration, the one or more stacking features optionally include corner indents 129 on the outer surface of the base 104 and corresponding corner ribs 131 in the interior of the base 104 as illustrated in FIG. 11. When a plurality of stack bases 104 are stacked together, the corner ribs 131 in the interior of the base 104 of a lower positioned base are configured to at least partially receive the corner indents 129 on the outer surface of the base 104 nest in the lower base 104. As can be appreciated, the corner ribs 131 in the interior of the base 104 and/or the corner indents 129 on the outer surface of the base 104 can be used to 1) facilitate in the stability of multiple stacked bases 104, and/or 2) provide structural rigidity to the base 104 of each of the storage boxes 100.

While FIGS. 1-12 generally illustrate the exemplary storage box 100 as including all the one or more stacking features discussed above, the present disclosure is not necessarily limited thereto. That is, the storage box could be provided with only one or a combination of any of the one or more stacking features without departing from the scope of the present disclosure.

Referring now to FIG. 8 and as briefly mentioned above, a non-limiting embodiment of a plurality of storage boxes 100 provided in a stacked configuration 200 is shown. More particularly, FIG. 8 illustrates a shelf unit 202 that might be in a store which sells the exemplary storage boxes 100 of the present disclosure. The shelf unit 202 includes one or more shelves 204, each of which can be provided with a plurality of stacked storage boxes 206*a*-206*d*. Each storage box 100 in the plurality of stacked storage boxes 206*a*-206*d* has identical features to that of exemplary storage box 100 discussed above, including the aforementioned one or more stacking features which enable stacking in a stable, space-saving manner.

The storage boxes described herein can be made from any desired material, the particular material used being non-limiting. For example, the storage boxes can be made from plastic, polymer, rubber, metal, wood, etc., without departing from the scope of the present disclosure. Moreover, while the storage boxes described herein are particularly suitable to the organization and storing of school-related material such as pens, pencils, erasers, scissors, crayons, markers, etc., any desired item can be stored within the presently described boxes without departing from the scope of the present disclosure. Moreover, the dimensions of the storage boxes described in the present disclosure are non-limiting, and it should be understood that the exemplary storage boxes can be sized to have any desired dimension without departing from the scope of the present disclosure. In any event, however, the exemplary storage boxes should at least be dimensioned to be able to store common school-related supplies such as the pens, pencils, erasers, scissors, crayons, markers, etc., listed above.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall there between. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed is:

1. A storage box, comprising:

a base; said base includes an open interior, a bottom portion, a side wall and top base flange; said top base flange is connected to said side wall of said base and is positioned between a top edge and a bottom edge of said side wall; said top base flange extends outwardly from an exterior surface of said side wall such that an outer perimeter of said top base flange is greater than an outer perimeter of said side wall that is a) located above and adjacent to said top base flange and b) located below and adjacent to said top base flange; said rim including a top surface and a bottom surface; said top base flange extends about at least a portion of a periphery of said side wall;

a lid that is permanently hingedly connected to said base by a hinge; said lid is movable between a closed position and an open position; said lid has a bottom surface;

a latch mechanism that is configured to secure said lid in said closed position; said latch mechanism includes a flexible member that is disposed on said lid; said flexible member is configured to releasably engage said bottom surface of said top base flange to releasably secure said lid in said closed position; said latch mechanism includes an engagement structure that is positioned on a rear surface of said latch mechanism and extends rearwardly from said rear side of said latch mechanism; said flexible member is configured to overlie a portion of an outer front edge of said top base flange when said lid is in said secure and closed position; said latch mechanism is spaced from said hinge; at least a portion of said engagement structure is positioned under said bottom surface of said top base flange when said lid is in said secure and closed position; and, a latch stop is configured to limit lateral movement of said latch mechanism relative to said base when said lid is in said secure and closed position; said latch stop is positioned at least partially below said bottom surface of said top base flange; at least a portion of said flexible member is configured to overlie at least a portion of a front surface of said latch stop when said lid is in said secure and closed position; at least a portion of said engagement structure is positioned between said latch stop when said latch mechanism secures said lid said closed position; said engagement structure is limited in lateral movement relative to same base by said latch stop when said lid is in said secure and closed position.

2. The storage box as defined in claim 1, wherein said base further incudes a permanent divider; said divider separates said open interior of said base into at least two storage areas; said divider extending upwardly from a top surface of said bottom portion of said base.

3. The storage box as defined in claim 1, wherein said base further incudes a recessed grip; the recessed grip is comprised of one or more channels formed on said bottom portion of said base.

4. The storage box as defined in claim 1, wherein said base further includes a ruler permanently formed in said side wall of said base.

5. The storage box as defined in claim 4, wherein said ruler includes two or more of a) a plurality of indentations, b) a plurality of raised ribs and c) numbering.

6. The storage box as defined in claim 1, wherein said lid includes a stop wall; said stop wall is position on said bottom surface of said lid; said stop wall is positioned rearwardly of said latch mechanism; at least a portion of said stop wall extends downwardly from said bottom surface of said lid; said stop wall is configured to limit both a) downward movement of at least a portion of said lid when said lid is in a closed position and b) outward movement of at least a portion of said lid from said base when said lid is in a closed position.

7. The storage box as defined in claim 6, wherein said stop wall includes a first retaining structure; at least a portion of said first retaining structure extends below said top edge of said base said lid when said lid is in said closed position; said first retaining structure is configured to limit movement of said latch mechanism outwardly from said side wall of said base when said lid is in said closed position.

8. The storage box as defined in claim 6, wherein said stop wall includes a lid stop structure; said lid stop structure is configured to overlie at least a portion of a top surface of said side wall when said lid is in said closed position; a bottom surface of said stop wall is configured to engage said top surface of said side wall to limit downward movement of at least a portion of said lid relative to said base when said lid is in said closed position.

9. The storage box as defined in claim 7, wherein said stop wall includes a lid stop structure; said lid stop structure is configured to overlie at least a portion of a top surface of said side wall when said lid is in said closed position; a bottom surface of said stop wall is configured to engage said top surface of said side wall to limit downward movement of at least a portion of said lid relative to said base when said lid is in said closed position.

10. The storage box as defined in claim 6, further including one or more stacking features configured to enable a stacked configuration of a plurality of said storage boxes in said open position.

11. The storage box as defined in claim 10, wherein said one or more stacking features include one or more apertures located on said lid and above said flexible member of said latch mechanism; said one or more apertures configured to receive at least a portion of said stop wall of a lid of a stacked storage box when said lid of said stacked storage box is stacked on said bottom surface of said lid.

12. The storage box as defined in claim 1, wherein said top base flange extends fully about said periphery of said side wall.

13. The storage box as defined in claim 1, wherein said latch mechanism fully overlies said front surface of said latch stop when said lid is in said closed position.

14. A storage box, comprising:

a base; said base includes an open interior, a bottom portion, a side wall and top base flange; said top base flange is connected to said side wall of said base and is positioned between a top edge and a bottom edge of said side wall; said top base flange extends outwardly from an exterior surface of said side wall such that an outer perimeter of said top base flange is greater than an outer perimeter of said side wall that is a) located above and adjacent to said top base flange and b) located below and adjacent to said top base flange; said top base flange extends about at least a portion of a periphery of said side wall;

a lid that is permanently hingedly connected to said base by a hinge; said lid is movable between a closed position and an open position; said lid has a bottom surface;

said lid includes a stop wall; said stop wall is position on said bottom surface of said lid; said stop wall is positioned rearwardly of a latch mechanism; at least a portion of said stop wall extends downwardly from said bottom surface of said lid; said stop wall is configured to limit both a) downward movement of at least a portion of said lid when said lid is in a closed position and b) outward movement of at least a portion of said lid from said base when said lid is in a closed position; and, said latch mechanism is configured to secure said lid in said closed position; said latch mechanism includes a flexible member that is disposed on said lid; said flexible member is configured to releasably engage said bottom surface of said top base flange to releasably secure said lid in said closed position; said latch mechanism includes an engagement structure that is positioned on a rear surface of said latch mechanism and extends rearwardly from said rear side of said latch mechanism; said flexible member is configured to overlie a portion of an outer front edge of said top base flange when said lid is in said secure and closed position; said latch mechanism spaced from said hinge; at least a portion of said engagement structure is positioned under said bottom surface of said top base flange when said lid is in said secure and closed position.

15. The storage box as defined in claim 14, wherein said stop wall includes a first retaining structure; at least a portion of said first retaining structure extends below said top edge of said base said lid when said lid is in said closed position; said first retaining structure is configured to limit movement of said latch mechanism outwardly from said side wall of said base when said lid is in said closed position.

16. The storage box as defined in claim 14, wherein said stop wall includes a lid stop structure; said lid stop structure is configured to overlie at least a portion of a top surface of said side wall when said lid is in said closed position; a bottom surface of said stop wall is configured to engage said top surface of said side wall to limit downward movement of at least a portion of said lid relative to said base when said lid is in said closed position.

17. The storage box as defined in claim 15, wherein said stop wall includes a lid stop structure; said lid stop structure is configured to overlie at least a portion of a top surface of said side wall when said lid is in said closed position; a bottom surface of said stop wall is configured to engage said top surface of said side wall to limit downward movement of at least a portion of said lid relative to said base when said lid is in said closed position.

18. The storage box as defined in claim 14, further including a latch stop that is configured to limit lateral movement of said latch mechanism relative to said base when said lid is in said secure and closed position; said latch stop is positioned at least partially below said bottom surface of said top base flange; at least a portion of said flexible member is configured to overlie at least a portion of a front surface of said latch stop when said lid is in said secure and closed position; at least a portion of said engagement structure is positioned between said latch stop when said latch mechanism secures said lid said closed position; said engagement structure is limited in lateral movement relative to same base by said latch stop when said lid is in said secure and closed position.

19. The storage box as defined in claim 14, further including one or more stacking features configured to enable a stacked configuration of a plurality of said storage boxes in said open position; said one or more stacking features include one or more apertures located on said lid and above said flexible member of said latch mechanism; said one or more apertures configured to receive at least a portion of said stop wall of a lid of a stacked storage box when said lid of said stacked storage box is stacked on said bottom surface of said lid.

* * * * *